US009030280B2

(12) United States Patent
Takahashi et al.

(10) Patent No.: US 9,030,280 B2
(45) Date of Patent: May 12, 2015

(54) ELECTROMAGNETICALLY OPERATED DEVICE AND SWITCHING DEVICE INCLUDING THE SAME

(75) Inventors: Kazuki Takahashi, Tokyo (JP); Mitsuru Tsukima, Tokyo (JP); Tomoko Tanabe, Tokyo (JP); Taehyun Kim, Tokyo (JP); Toru Kimura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 14/129,807

(22) PCT Filed: Sep. 10, 2012

(86) PCT No.: PCT/JP2012/073028

§ 371 (c)(1),
(2), (4) Date: Dec. 27, 2013

(87) PCT Pub. No.: WO2013/042566

PCT Pub. Date: Mar. 28, 2013

(65) Prior Publication Data

US 2014/0132373 A1 May 15, 2014

(30) Foreign Application Priority Data

Sep. 19, 2011 (JP) ..... 2011-203935
Mar. 6, 2012 (JP) ..... 2012-048832

(51) Int. Cl.
*H01H 67/02* (2006.01)
*H01H 1/54* (2006.01)
*H01H 33/666* (2006.01)

(52) U.S. Cl.
CPC ..... *H01H 1/54* (2013.01); *H01H 33/6662* (2013.01)

(58) Field of Classification Search
CPC ..... H01H 1/45; H01H 3/46; H01H 33/00; H01H 33/006; H01H 33/02; H01H 33/666; H01H 36/00; H01H 9/08; H01H 67/00; H01H 47/00; H01F 3/00
USPC ..... 335/131–133, 229–234, 245, 179, 189, 335/256; 218/134, 139, 154
See application file for complete search history.

(56) References Cited

U.S. PATENT DOCUMENTS 3,883,839 A * 5/1975 Barrett et al. ..... 338/116
4,157,520 A * 6/1979 Moates et al. ..... 335/230

(Continued)

FOREIGN PATENT DOCUMENTS

JP 6 86303 12/1994
JP 11 186029 7/1999

(Continued)

OTHER PUBLICATIONS

International Search Report Issued Oct. 9, 2012 in PCT/JP12/073028 Filed Sep. 10, 2012.

*Primary Examiner* — Shawki S Ismail
*Assistant Examiner* — Lisa Homza
(74) *Attorney, Agent, or Firm* — Oblon, McClelland, Maier & Neustadt, L.L.P.

(57) ABSTRACT

An electromagnetically operated device includes: a moving member of the electromagnetically operated device; a drive coil that is energized to generate magnetic flux for driving the moving member; a permanent magnet provided between a stationary member and the moving member for holding the moving member; and a holding force adjusting member for adjusting the holding force applied to the moving member by the permanent magnet, wherein the holding force adjusting member is placed at a position that will not be included in the main magnetic path of the magnetic flux caused by the drive coil so as to be removable.

12 Claims, 57 Drawing Sheets

(56) References Cited

U.S. PATENT DOCUMENTS

| | | | | | |
|---|---|---|---|---|---|
| 4,367,448 | A * | 1/1983 | Nishizako | 335/201 |
| 4,550,302 | A * | 10/1985 | Watanabe et al. | 335/228 |
| 4,554,425 | A * | 11/1985 | Kashiwagi et al. | 218/130 |
| 4,560,969 | A * | 12/1985 | Nicholson | 335/272 |
| 4,640,999 | A * | 2/1987 | Kashiwagi et al. | 218/130 |
| 4,682,063 | A * | 7/1987 | Lembke | 310/29 |
| 4,686,338 | A * | 8/1987 | Kashiwagi et al. | 200/264 |
| 5,034,714 | A * | 7/1991 | Bratkowski et al. | 335/234 |
| 5,473,298 | A * | 12/1995 | Teutsch | 335/237 |
| 5,519,370 | A * | 5/1996 | Perreira et al. | 335/154 |
| 5,557,083 | A * | 9/1996 | Komuro et al. | 218/123 |
| 5,697,150 | A * | 12/1997 | Komuro et al. | 29/875 |
| 5,852,266 | A * | 12/1998 | Komuro et al. | 218/119 |
| 5,892,194 | A * | 4/1999 | Uotome et al. | 218/68 |
| 5,903,203 | A * | 5/1999 | Elenbaas | 335/179 |
| 7,182,051 | B2 * | 2/2007 | Sedda et al. | 123/90.11 |
| 7,812,273 | B2 * | 10/2010 | Takahara et al. | 200/293 |
| 7,852,178 | B2 * | 12/2010 | Bush et al. | 335/126 |
| 2002/0043517 | A1 * | 4/2002 | Koyama et al. | 218/154 |
| 2002/0044036 | A1 * | 4/2002 | Akita et al. | 335/256 |
| 2002/0044403 | A1 * | 4/2002 | Takeuchi et al. | 361/152 |
| 2005/0189825 | A1 * | 9/2005 | Brodt et al. | 310/32 |
| 2008/0302765 | A1 * | 12/2008 | Renz et al. | 218/134 |
| 2010/0271155 | A1 * | 10/2010 | Kaneda et al. | 335/126 |
| 2012/0169441 | A1 * | 7/2012 | Kim et al. | 335/179 |
| 2012/0274428 | A1 * | 11/2012 | Reuber et al. | 335/6 |
| 2012/0306601 | A1 * | 12/2012 | Kim | 335/179 |
| 2013/0146565 | A1 * | 6/2013 | Nakayama et al. | 218/120 |
| 2013/0161291 | A1 * | 6/2013 | Kim et al. | 218/134 |
| 2013/0214886 | A1 * | 8/2013 | Ohtsuka et al. | 335/189 |

FOREIGN PATENT DOCUMENTS

| | | |
|---|---|---|
| JP | 2003 31088 | 1/2003 |
| JP | 2010 287674 | 12/2010 |

* cited by examiner

ELECTROMAGNETICALLY OPERATED DEVICE AND SWITCHING DEVICE INCLUDING THE SAME

TECHNICAL FIELD

The present invention relates to an electromagnetically operated device and a switching device including the electromagnetically operated device.

BACKGROUND ART

Generally, a switching device including an electromagnetically operated device, for example, an electromagnetically operated vacuum circuit breaker includes: a vacuum valve for switching main circuit current; an electromagnetically operated device for driving the vacuum valve; a pressure spring for suppressing electromagnetic repulsion between the contacts caused by a short circuit; an opening spring for increasing the opening speed; and an insulating rod and coupling bar for coupling the electromagnetically operated device to the vacuum valve.

As a requirement of the electromagnetically operated vacuum circuit breaker configured as above, when an overcurrent flows due to a short circuit or the like, the electromagnetically operated device opens the contact of the vacuum valve to interrupt the overcurrent. The electromagnetically operated device is required to perform opening operation immediately after the overcurrent is detected. Furthermore, when the vacuum valve is closed, the electromagnetically operated device is held by magnetic flux of a permanent magnet. When the vacuum valve is to be opened, an opening coil (i.e., drive coil) is energized to cancel the magnetic flux of the permanent magnet, thereby causing the electromagnetically operated device to operate. So, when the holding force (the amount of flux) of the permanent magnet varies due to individual variability, the time from when an opening instruction is received until when the magnetic flux generated by the permanent magnet is canceled varies. Accordingly, the opening operation may vary. As such, if the variation in the holding force of the permanent magnet can be reduced, the variation in the opening operation can also be reduced.

Conventionally, in order to reduce the variation range of the holding force, the residual flux density tolerance or dimensional tolerance of the permanent magnet is reduced. However, correspondingly, the increase in time for adjustment and selection of the magnet result in increase in the cost. As such, if the holding force of the permanent magnet can be easily adjusted, the electromagnetically operated device can be configured at a lower cost.

For example, JP-UM-A-6-86303 (PTL 1) discloses an electromagnet device for overcurrent tripping in which the position of a magnetic material can be adjusted using a screw to divert the magnetic flux and adjust the magnetic attractive force toward a rotary armature.

CITATION LIST

Patent Literature

PTL 1: JP-UM-A-6-86303

SUMMARY OF INVENTION

Technical Problem

The electromagnetically operated device uses magnetic force of the permanent magnet to hold closed the contact of the switching device, the holding force of which significantly varies depending on the dimensional tolerance or residual flux density tolerance of the permanent magnet, the dimensional tolerance between a stationary member and a moving member or the like. This variation in the holding force of the permanent magnet is a problem in designing the electromagnetically operated device. In order to reduce the variation range of the holding force, the dimensional tolerance of individual members and the range of residual flux density tolerance need to be reduced. This leads to an increase in time for fabrication (adjustment) and an increase in magnet cost.

It is an object of the present invention to provide an electromagnetically operated device with less variable holding force in which a member for adjusting the variation in the holding force of the electromagnetically operated device is used to absorb the variation in the holding force of a permanent magnet, and a switching device including the electromagnetically operated device.

Solution to Problem

An electromagnetically operated device in accordance with the invention includes: a moving member of the electromagnetically operated device; a drive coil (closing and opening coil) that is energized to generate magnetic flux for driving the moving member; a permanent magnet provided between a stationary member and the moving member for holding the moving member; and a holding force adjusting member for adjusting the holding force applied to the moving member by the permanent magnet, wherein the holding force adjusting member is placed at a position that will not be included in the main magnetic path of the magnetic flux caused by the drive coil, between the moving member and a magnetic pole face opposite the moving member.

Advantageous Effects of Invention

According to the invention, the holding force adjusting member is placed at a position that will not be included in the main magnetic path of the magnetic flux caused by the drive coil (closing and opening coil) in the opening and closing operations to absorb the variation in the holding force of the electromagnetically operated device, which can provide an electromagnetically operated device with less variable holding force or a switching device including the electromagnetically operated device without leading to increase in time for fabrication (adjustment) and increase in the cost of magnet.

DESCRIPTION OF EMBODIMENTS

A preferable embodiment of an electromagnetically operated device and a switching device including the electromagnetically operated device in accordance with the invention is described below with reference to the drawings. Note that, as an example of the switching device including the electromagnetically operated device, an electromagnetically operated vacuum circuit breaker is described. However, this embodiment is not intended to limit the invention, but various design changes can be made to this embodiment. Furthermore, through the drawings illustrating the embodiments, the same numerals denote the same or corresponding portions.

First Embodiment

Figure 1:
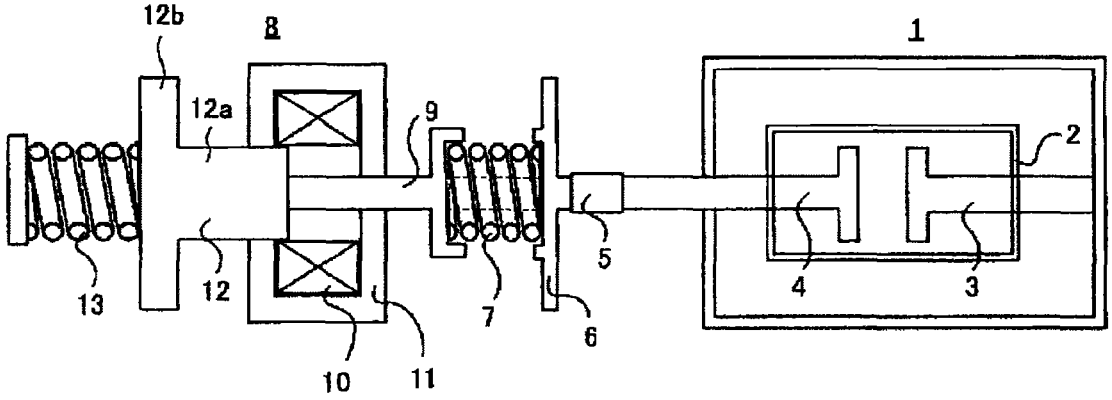
FIG. 1 A configuration diagram showing an electromagnetically operated vacuum circuit breaker in accordance with a first embodiment of the invention in the opening state.

FIG. 1 shows a configuration of an electromagnetically operated vacuum circuit breaker in accordance with a first embodiment of the invention when the circuit breaker is in the opening state. Referring to FIG. 1, a vacuum valve 2 that is a circuit breaker part of the electromagnetically operated vacuum circuit breaker (hereinafter simply referred to as "vacuum circuit breaker") 1 contains in a vacuum container a stationary electrode 3 and a moving electrode 4 that is placed a predetermined distance away from the stationary electrode 3 and comes in contact with or separate from the stationary electrode 3. The moving electrode 4 is coupled to a coupling bar 9 of an electromagnetically operated device 8 through a insulating rod 5, a spring seat 6 and a pressure spring 7 for suppressing electromagnetic repulsion between the contacts caused by a short circuit.

The electromagnetically operated device 8 includes: a drive coil (closing and opening coil) 10 for generating drive force that causes the coupling bar 9 to move in the axis direction; a stationary member 11 for containing the drive coil (closing and opening coil) 10; a moving member 12 that is coupled to the coupling bar 9 and is caused to move by magnetic flux generated by the drive coil (closing and opening coil) 10; and an opening spring 13 for increasing the opening speed between the stationary electrode 3 and the moving electrode 4. Depending on the required opening speed of the vacuum circuit breaker 1, the opening spring 13 may not be used. The moving member 12 includes: a moving member center portion 12*a* that moves in the center space of the drive coil (closing and opening coil) 10; and a moving member opposite portion 12*b* that is opposite to one surface of the stationary member 11 on the opening spring 13 side. Note that FIG. 1 shows the configuration only for single phase. However, in the case of three phases, the configurations for three phases are placed in parallel at predetermined intervals. In the case of three phases, one electromagnetically operated device 8 may also drive the vacuum valves 2 for three phases.

Figure 2:
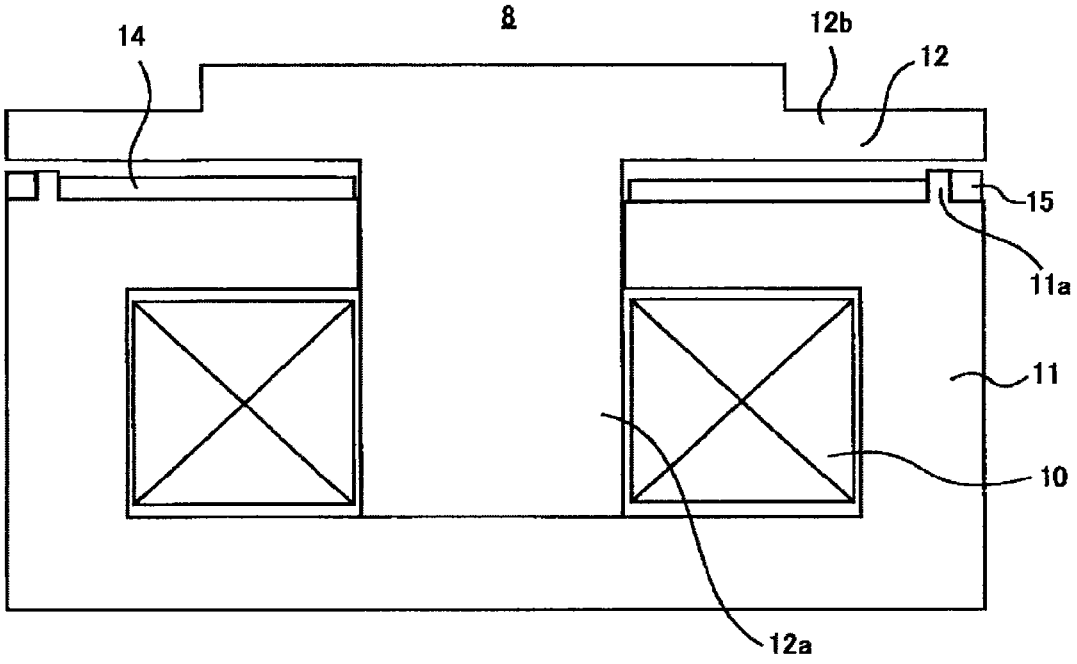
FIG. 2 A front view showing an electromagnetically operated device in accordance with the first embodiment of the invention.
Figure 3:
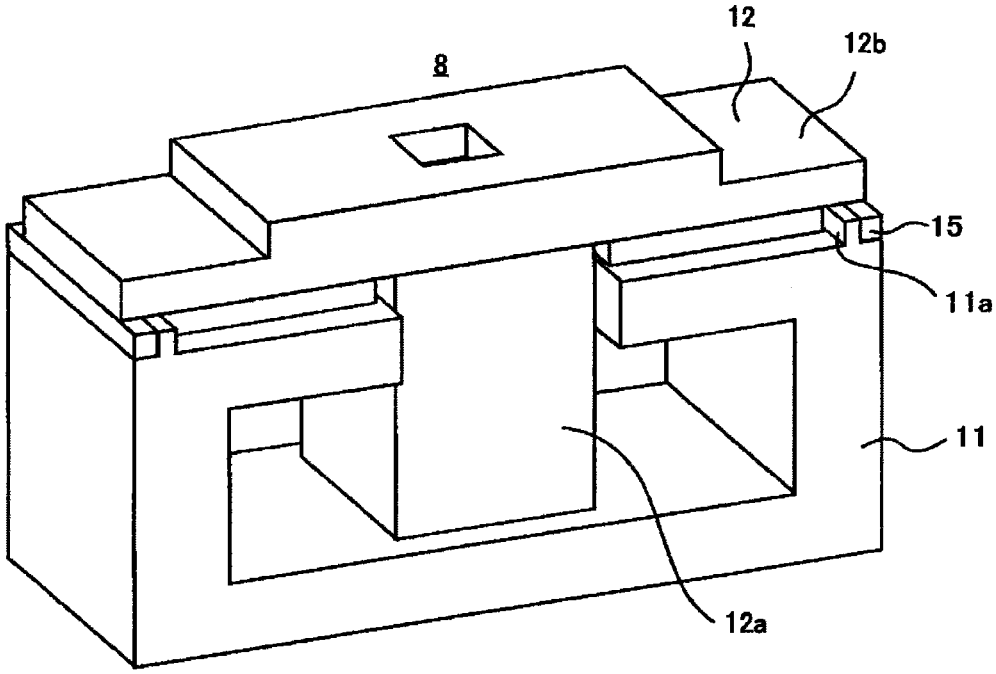
FIG. 3 A perspective view showing the electromagnetically operated device in accordance with the first embodiment of the invention.

FIGS. 2 and 3 are a front view and a perspective view illustrating the electromagnetically operated device 8 in detail, respectively. As shown in FIGS. 2 and 3, the electromagnetically operated device 8 includes a permanent magnet 14 and a holding force adjusting member 15 in addition to the moving member 12, the stationary member 11 and the drive coil (closing and opening coil) 10. Note that, in FIGS. 2 and 3, an opening coil and a closing coil are shown as one coil (the drive coil (closing and opening coil) 10). However, the opening coil and the closing coil may be individually configured.

The permanent magnet 14 and the holding force adjusting member 15 are provided on the stationary member 11 and placed on the surface opposite to the moving member opposite portion 12*b*. On the surface of the stationary member 11 opposite to the moving member opposite portion 12*b*, a boundary protruding portion 11*a* is formed to divide the opposite surface into a center portion and an outer portion. The permanent magnet 14 is placed on the center portion side of the surface of the stationary member 11 opposite to the moving member opposite portion 12*b*. The holding force adjusting member 15 is placed on the outer portion side of the surface of the stationary member 11 opposite to the moving member opposite portion 12*b*. Note that the holding force adjusting member 15 is removable due to being provided on the surface of the stationary member 11 opposite to the moving member opposite portion 12*b*. The boundary protruding portion 11*a* is configured, for example, by forming notches or grooves on the center portion side and the outer portion side of the surface of the stationary member 11 opposite to the moving member opposite portion 12*b*.

Figure 4:
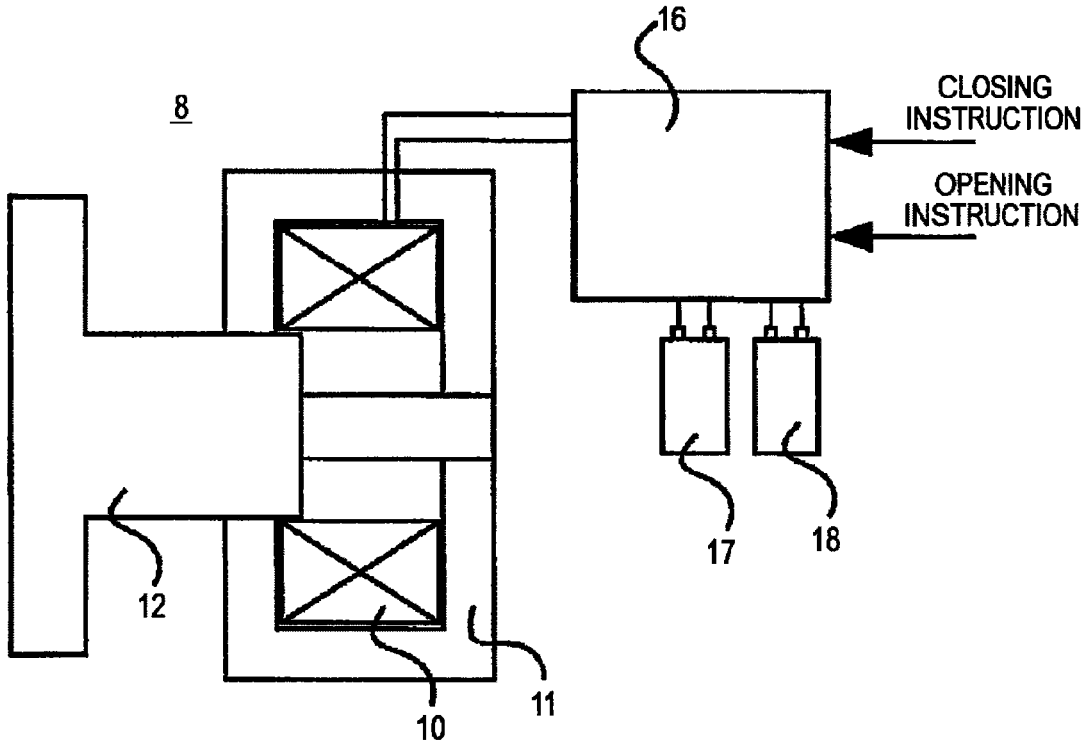
FIG. 4 A diagram showing a circuit configuration of the electromagnetically operated device in accordance with the first embodiment of the invention.

FIG. 4 shows a circuit configuration of the electromagnetically operated device 8. An operation board 16 includes capacitors 17 and 18 for storing electric charge for energizing the drive coil (closing and opening coil) 10. The capacitors 17 and 18 are used for closing and opening operations, respectively. The closing capacitor 17 and the opening capacitor 18 are configured to be charged to a certain voltage by a charging control circuit. The charging control circuit operates on an external power supply. Here, the charging control circuit and the external power supply are not shown. When the operation board 16 receives a closing instruction or an opening instruction from the outside, a charge is discharged from the closing capacitor 17 or the opening capacitor 18 to the drive coil (closing and opening coil) 10. Note that, in FIG. 4, the capacitors are shown as an example of the power supply for the drive coil (closing and opening coil) 10 for the opening/closing operation. However, any appropriate power supply other than the capacitors may also be used.

Figure 5:
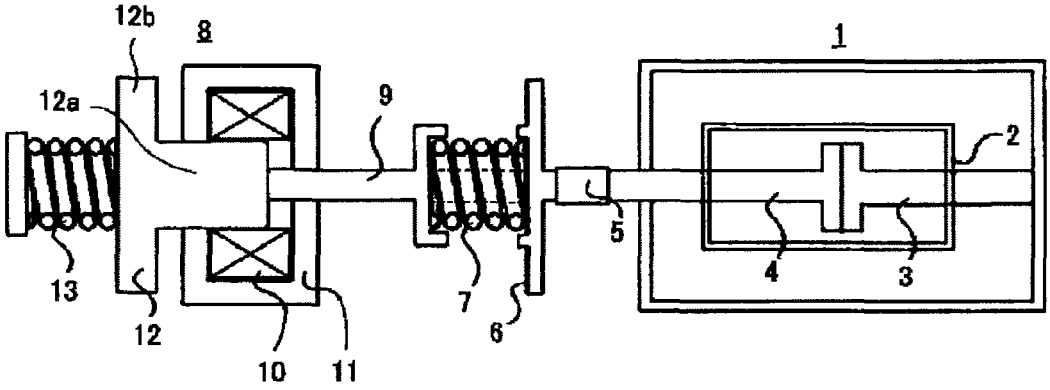
FIG. 5 A configuration diagram showing the electromagnetically operated device in accordance with the first embodiment of the invention when a moving electrode abuts against a stationary electrode.
Figure 6:
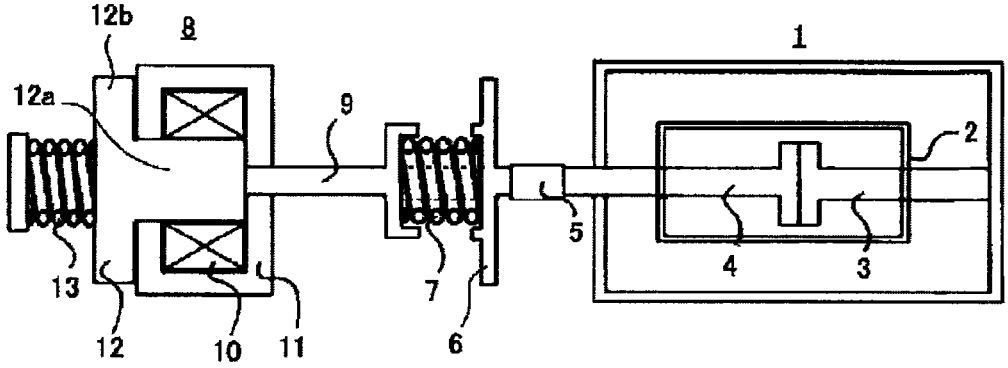
FIG. 6 A configuration diagram showing the electromagnetically operated device in accordance with the first embodiment of the invention when the closing operation is completed.

Next, the closing operation and the opening operation are described with reference to FIGS. 1-6. With the vacuum circuit breaker 1 in the opening state as shown in FIG. 1, when a closing instruction is input to the operation board 16 shown in FIG. 4, a charge stored in the closing capacitor 17 is supplied to the drive coil (closing coil) 10, then an electromagnetic force generated by the drive coil (closing coil) 10 causes the moving member 12 of the electromagnetically operated device 8 to move in the axis direction (to the right side in FIG. 1), and then the coupling bar 9, the pressure spring 7, the spring seat 6, the insulating rod 5 and the moving electrode 4 that are coupled to the moving member 12 move together in the same direction. According to the structure of the vacuum circuit breaker 1, when the moving electrode 4 abuts against the stationary electrode 3 as shown in FIG. 5, the tip of the moving member center portion 12*a* of the moving member 12 of the electromagnetically operated device 8 has not abutted against the stationary member 11 yet. Accordingly, the magnetic flux generated by the drive coil (closing coil) 10 further causes the moving member 12 to move in the axis direction, then, when the pressure spring 7 is compressed and the tip of the moving member center portion 12*a* abuts against the stationary member 11, everything stops into the closing state as shown in FIG. 6. After the closing is completed, the supply of charge to the drive coil (closing coil) 10 is stopped, then the closing state is maintained by magnetic flux of the permanent magnet 14. Note that, in the closing operation, the drive coil (closing coil) 10 is energized in a polarity such that the direction of the magnetic flux generated by the drive coil (closing coil) 10 is the same as that of the magnetic flux of the permanent magnet 14 in the moving member center portion 12*a*. Furthermore, in the closing state, the moving member opposite portion 12*b* is opposite to the stationary member 11 with a small gap in between.

Next, with the vacuum circuit breaker 1 in the closing state as shown in FIG. 6, when an opening instruction is input to the operation board 16, a charge is discharged from the opening capacitor 18 to the drive coil (opening coil) 10. At this time, the drive coil (opening coil) 10 is energized in the opposite polarity to that in the closing operation to generate magnetic flux in the opposite direction to that in which magnetic flux is generated by the permanent magnet 14 toward the moving member opposite portion 12*b* in the closing operation. When the charge stored in the opening capacitor 18 is discharged to the drive coil (opening coil) 10, the holding force of the permanent magnet 14 is reduced. Then, when the holding force becomes less than or equal to the total amount of the final loads of the pressure spring 7 and the opening spring 13, the closing state is no longer maintained, then the moving member 12 moves to the left side of FIG. 6, and then the coupling bar 9 coupled to the moving member 12 moves in the same direction. Accordingly, the pressure spring 7 starts to extend. When the pressure spring 7 extends to the maximum length (not the free length) that is defined from its structure, the insulating rod 5 and the moving electrode 4 move together with the moving member 12, the coupling bar 9 and the pressure spring 7 in the same direction.

Although not shown, a stationary plate is provided on the left side of the moving member 12. When the moving member 12 abuts against the stationary plate, the vacuum circuit breaker 1 transitions into the opening state.

Figure 7:
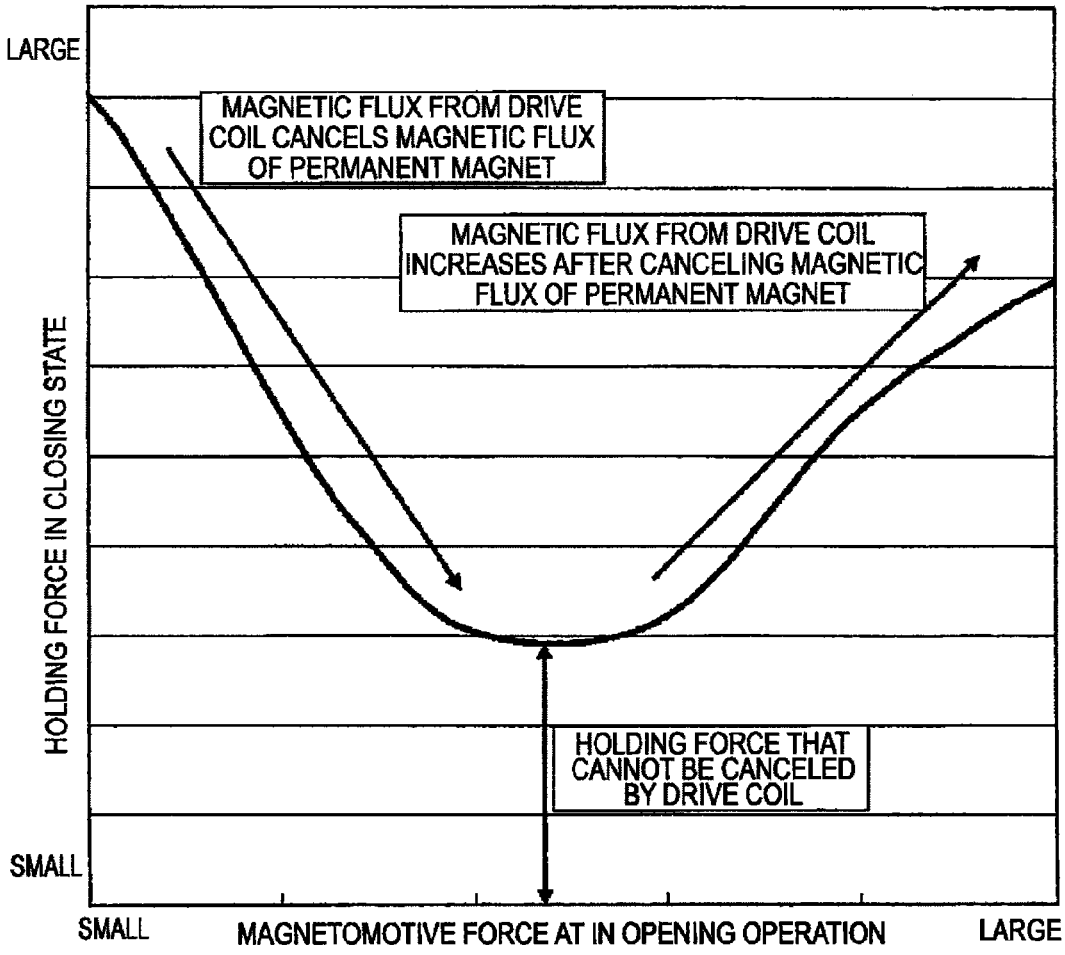
FIG. 7 A diagram showing the holding force characteristic of the electromagnetically operated device in accordance with the first to third embodiments of the invention when a drive coil (opening coil) is energized in the closing state.

Next, the characteristic of the holding force for holding the moving member 12 when the drive coil (opening coil) 10 is energized in the closing state is described. FIG. 7 shows the characteristic of the holding force for holding the moving member 12 when the drive coil (opening coil) 10 is energized in the closing state. In FIG. 7, the horizontal axis indicates magnetomotive force (A×T) that is the product of coil current A flowing in the drive coil (opening coil) 10 and number of turns T of the drive coil (opening coil) 10, while the vertical axis indicates holding force.

When the current flowing in the drive coil (opening coil) 10 increases (i.e., A×T increases), the magnetic flux caused by the drive coil (opening coil) 10 cancels the magnetic flux of the permanent magnet 14, thereby reducing the holding force. Then, when the magnetic flux caused by the drive coil (opening coil) 10 becomes larger than or equal to a certain magnetomotive force, the magnetic flux of the drive coil (opening coil) 10 becomes larger than the magnetic flux of the permanent magnet 19, thereby increasing the holding force. The holding force is proportional to the square of the magnetic flux, and so is not affected by the di-reaction of the magnetic flux. Here, the holding force occurs at three point, that is, from the moving member center portion 12*a* to the stationary member 11, from the moving member opposite portion 12*b* to the stationary member 11 (including the holding force adjusting member 15) and from the permanent magnet 14 to the moving member opposite portion 12*b*. On the other hand, the magnetic flux caused by the drive coil (opening coil) 10 cancels the magnetic flux from the moving member center portion 12*a* to the stationary member 11, but cannot completely cancel the magnetic flux from the moving member opposite portion 12*b* to the stationary member 11 (including the holding force adjusting member 15) and from the permanent magnet 14 to the moving member opposite portion 12*b*. If configured so that all of the holding force is canceled, the permanent magnet 14 may be demagnetized in the opening operation, which leads to deterioration of the permanent magnet 14. Accordingly, even when the magnetomotive force of the drive coil (opening coil) 10 is increased, the holding force does not decrease to zero. So, a certain amount of holding force that cannot be canceled by the drive coil (opening coil) 10 exists.

Figure 8:
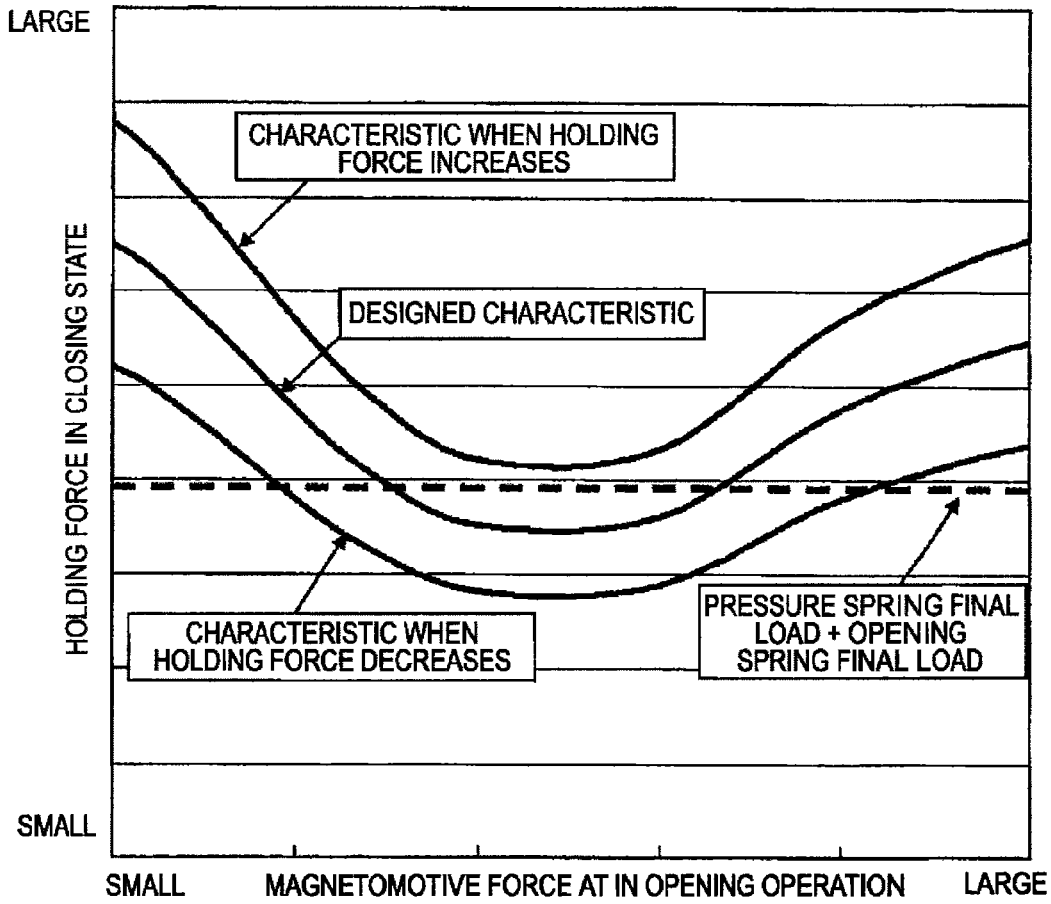
FIG. 8 A diagram showing the holding force characteristic of the electromagnetically operated device in accordance with the first to third embodiments of the invention when the drive coil (opening coil) is energized with the holding force increased or decreased due to individual variability.

FIG. 8 shows the relation between the magnetomotive force of the drive coil (opening coil) 10 and the holding force in the closing state when the holding force of the electromagnetically operated device 8 varies. According to the designed characteristic, the electromagnetically operated device 8 increases the magnetomotive force of the drive coil (opening coil) 10 and, when the holding force becomes less than or equal to the total amount (horizontal dotted line) of the final loads of the pressure spring 7 and the opening spring 13, performs the opening operation. With a characteristic in which the holding force increases due to individual variability of the electromagnetically operated device 8, since the magnetomotive force of the drive coil (opening coil) 10 increases, the holding force does not become less than or equal to the total amount of the final loads of the pressure spring 7 and the opening spring 13, thereby disabling the opening operation. In practice, the design is performed so that, even with an individual having an increased holding force, the holding force can be less than or equal to the total amount of the final loads of the pressure spring 7 and the opening spring 13, so the holding force needs to be within a target tolerance.

On the other hand, with a characteristic in which the holding force decreases, the holding force can be less than or equal to the total amount of the final loads of the pressure spring 7 and the opening spring 13, but the difference between the holding force with the drive coil (opening coil) 10 not energized (maintained in the closing state) and the total amount of the final loads of the pressure spring 7 and the opening spring 13 is small, then, when the holding force with the drive coil (opening coil) 10 not energized becomes less than or equal to the total amount of the final loads of the pressure spring 7 and the opening spring 13 due to time degradation of the permanent magnet 14 or ambient temperature variation, the closing state can be no longer maintained. As described above, when the holding force varies due to individual variability of the electromagnetically operated device 8, the performance of the electromagnetically operated device 8 is significantly affected, so suppressing variation in the holding force is important.

Figure 9:
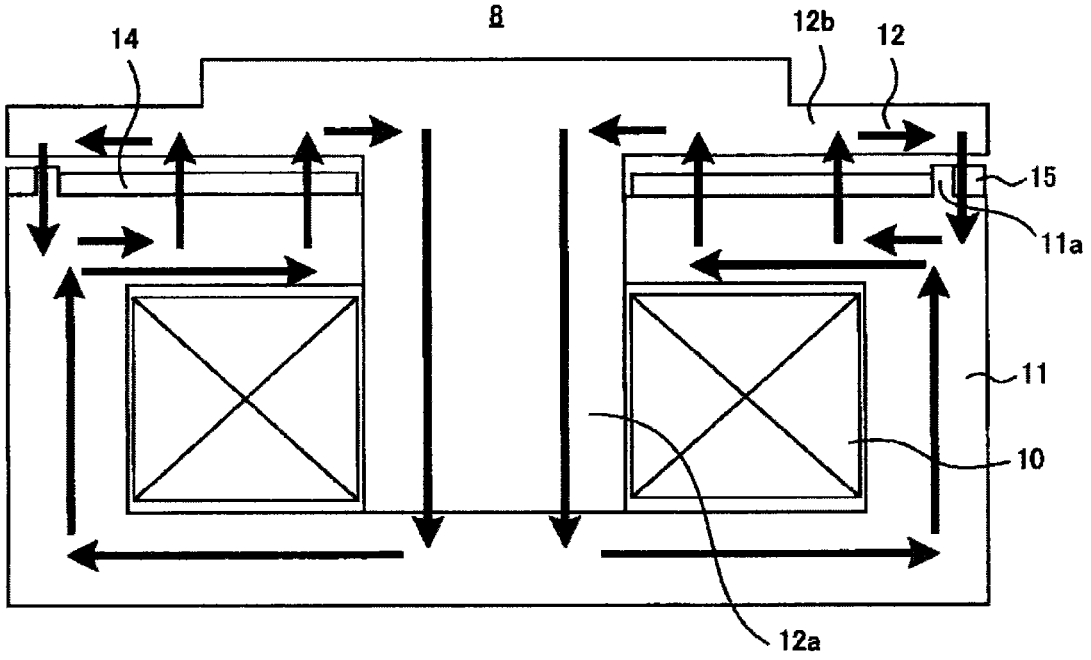
FIG. 9 A diagram showing the magnetic flux flow of a permanent magnet of the electromagnetically operated device in accordance with the first embodiment of the invention.

Next, the holding force adjustment of the electromagnetically operated device 8 is described. FIG. 9 is a diagram showing a flow of the magnetic flux of the permanent magnet 14 in the closing state. As shown in FIG. 9, the magnetic flux of the permanent magnet 14 forms three flux flows, that is, a flux flow from the moving member center portion 12*a* to the stationary member 11, a flux flow from the moving member opposite portion 12*b* to the stationary member 11 (including the holding force adjusting member 15) and a flux flow from the permanent magnet 14 to the moving member opposite portion 12*b*, to generate the holding force on the moving member 12.

Figure 10:
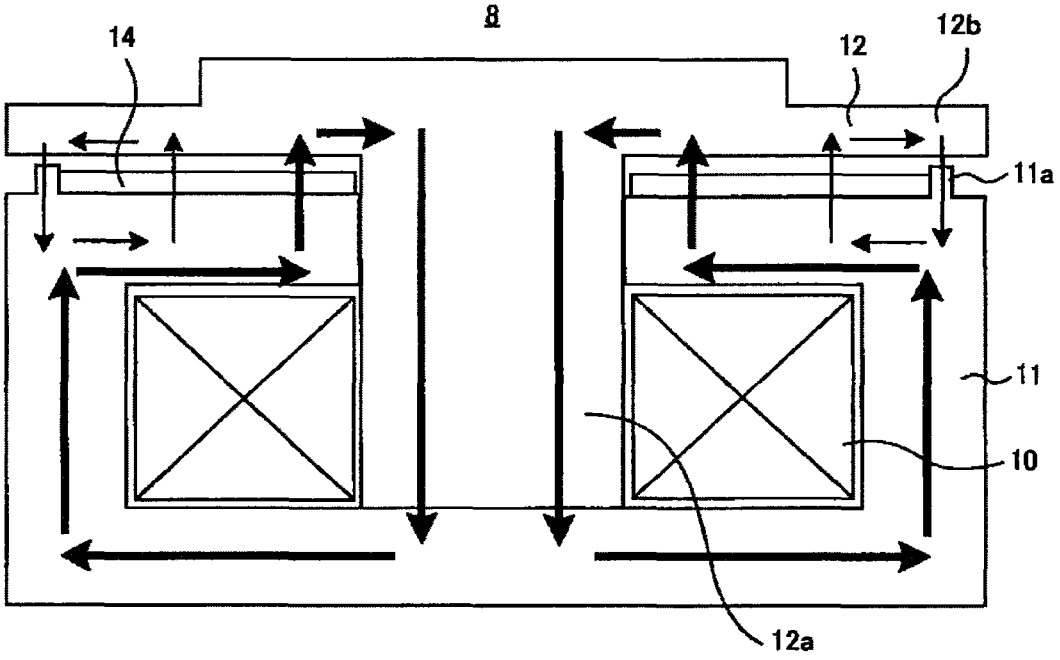
FIG. 10 A diagram showing the magnetic flux flow of the permanent magnet of the electromagnetically operated device in accordance with the first embodiment of the invention with a holding force adjusting member removed.
Figure 11:
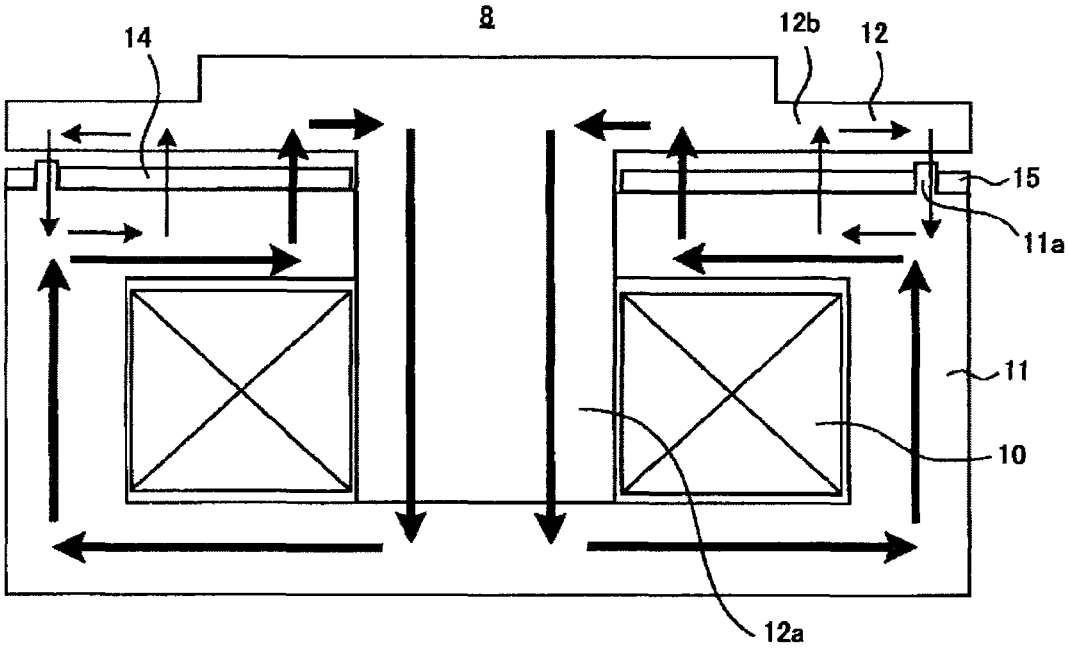
FIG. 11 A diagram showing the magnetic flux flow of the permanent magnet of the electromagnetically operated device in accordance with the first embodiment of the invention with a dimension of the holding force adjusting member changed.
Figure 12:
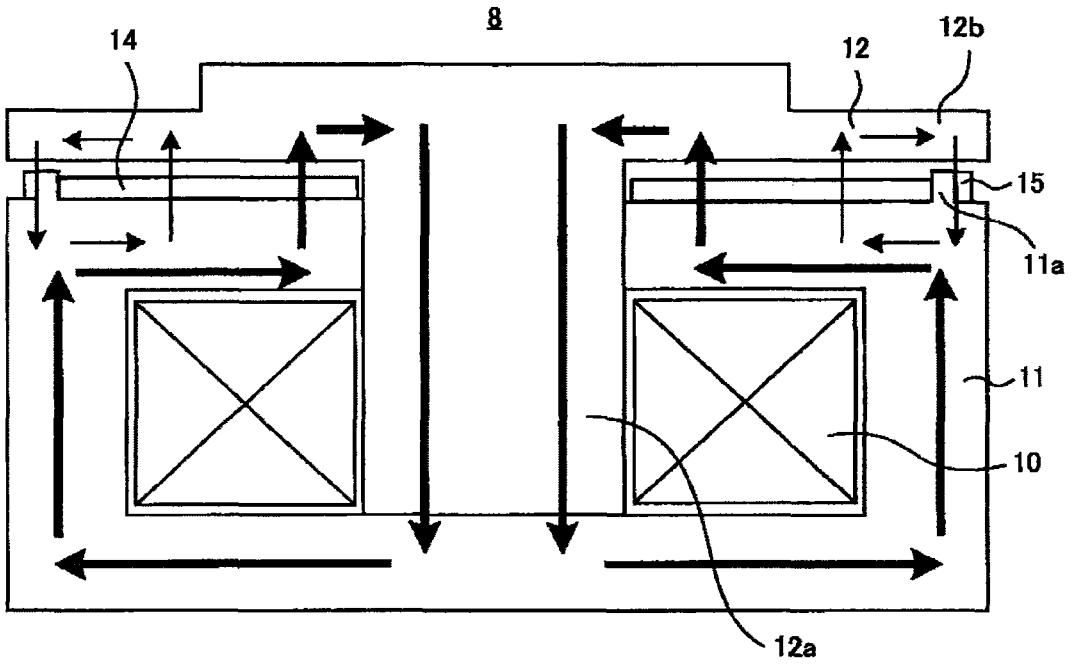
FIG. 12 A diagram showing the magnetic flux flow of the permanent magnet of the electromagnetically operated device in accordance with the first embodiment of the invention with a dimension of the holding force adjusting member changed.

FIG. 10 is a diagram in which the holding force adjusting member 15 is removed from the electromagnetically operated device 8. FIGS. 11 and 12 are diagrams in which the cross-sectional area of the holding force adjusting member 15 is changed. In these figures, thin arrows indicate that the amount of flowing magnetic flux decreases due to change of the holding force adjusting member 15.

The holding force adjusting member 15 may be in any appropriate shape as long as it has a structure in which dimensions in the height direction, lateral direction and thickness direction can be individually changed to change the cross-sectional area and the width of the gap with the moving member 12. Furthermore, instead of changing a dimension of the holding force adjusting member 15, a material having a different magnetic characteristic can be used to similarly adjust the holding force. Although FIGS. 10 to 12 shows the configurations for reducing the holding force, the holding force adjusting member 15 can also be configured to increasing the holding force by placing the holding force adjusting member 15 so that the width of the gap with the moving member opposite portion 12*b* is smaller (e.g., by increasing the dimension in the axis direction of the holding force adjusting member 15). In the holding force adjusting member 15, since the magnetic flux of the permanent magnet 14 passes through, there is no time variation in the magnetic flux and no eddy current occurs. So, although the fastening means is not shown, the holding force adjusting member 15 may be fastened by any appropriate means, such as a screw or a cover.

Furthermore, part of the side magnetic pole of the permanent magnet 14 is configured to be the holding force adjusting member 15 to separate the holding force adjusting member 15 from the permanent magnet 14, which reduces the force by which the holding force adjusting member 15 is attracted toward the permanent magnet 14 itself, thereby facilitating the fabrication. Note that, even when the whole of the side magnetic pole of the permanent magnet 14 (including the boundary protruding portion 11*a*) is configured to be the holding force adjusting member 15, the effect of enabling the holding force adjustment is maintained.

Furthermore, placing the holding force adjusting member 15 in a contact space in which the moving member center portion 12*a* comes in mechanical contact with the stationary member 11 can perform only one of increasing and decreasing the holding force (For example, when a non-magnetic member is placed in the contact space in the fabrication process, removing this non-magnetic member from the contact space increases the holding force. On the other hand, when an adjusting member is not placed in the contact space in the fabrication process, placing a non-magnetic member in the contact space afterward decreases the holding force). On the other hand, placing the holding force adjusting member 15 in a space in which the moving member 12 does not come automatically in contact with the stationary member 11 and a gap exists between the moving member 12 and the stationary member 11 as shown in FIG. 9 can perform both increasing and decreasing the holding force.

Since the holding force due to individual variability of the electromagnetically operated device 8 may be larger or smaller than the designed holding force, the capability of both increasing and decreasing the holding force is important. Furthermore, since the moving member opposite portion 12*b* does not come in contact with the holding force adjusting member 15 in the closing and opening operations, the holding force adjusting member 15 will not be deformed by the closing and opening operations.

The magnetic flux flow and holding force caused by the permanent magnet 14 has been described above. Then, the magnetic flux flow when the drive coil (closing and opening coil) 10 is energized is described below.

Figure 13:
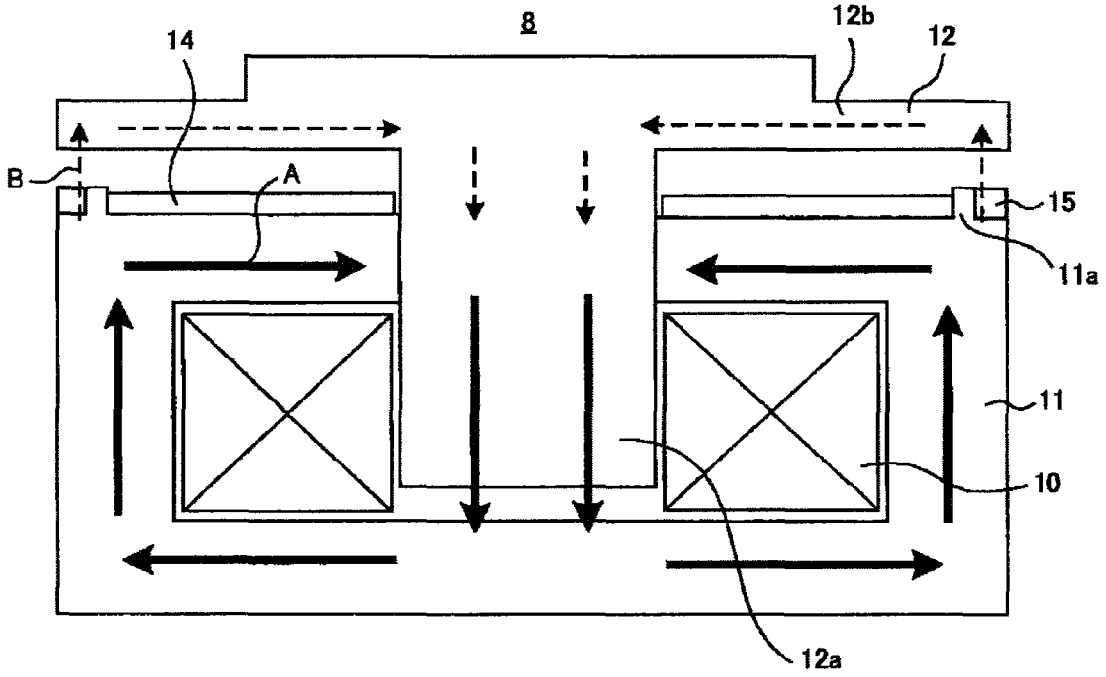
FIG. 13 A diagram showing the magnetic flux flow of the electromagnetically operated device in accordance with the first embodiment of the invention when the drive coil (closing coil) is energized in the state of the moving electrode abutting against the stationary electrode.

FIG. 13 shows the magnetic flux flow caused by the drive coil (closing coil) 10 when the pressure spring 7 starts to be compressed in the closing operation. Arrows in FIG. 13 indicate the magnetic flux generated by the drive coil (closing coil) 10. The main magnetic path of the magnetic flux generated by the drive coil (closing coil) 10 is indicated by solid arrows. The holding force adjusting member 15 is not included in the main magnetic path because a gap exists between the holding force adjusting member 15 and the moving member 12 and then the amount of magnetic flux passing through the holding force adjusting member 15 is small. Here, the main magnetic path of the drive coil (closing coil) 10 is a magnetic path with the smallest magnetic resistance in the magnetic paths of the magnetic flux generated by the drive coil (closing coil) 10. Among the magnetic flux vectors caused by the drive coil (closing coil) 10, the solid arrows indicate the main magnetic path and dotted arrows do not indicate the main magnetic path.

In this embodiment, even in the closing state, a gap exists between the moving member opposite portion 12*b* and the holding force adjusting member 15 (because the moving member opposite portion 12*b* does not abut against the holding force adjusting member 15), then the magnetic path of the magnetic flux caused by the drive coil (closing and opening coil) 10 is divided into a magnetic path A through the stationary member 11 between the drive coil (closing and opening coil) 10 and the permanent magnet 14, and a magnetic path B through the outside magnetic pole of the permanent magnet 14 (also including the holding force adjusting member 15).

In FIG. 13, the magnetic path A is the main magnetic path and the magnetic path B is not the main magnetic path. With the holding force adjusting member 15 placed on the stationary member 11 opposite the moving member opposite portion 12*b*, even when the position of the moving member 12 changes, the width of the gap existing in the magnetic path A between the side surfaces of the stationary member 11 and the moving member center portion 12*a* does not change, but, when the width of the gap between the stationary member 11 and the moving member opposite portion 12*b* becomes larger, the width of the gap existing in the magnetic path B also becomes larger to increase the magnetic resistance. Since the magnetic resistance of air gap is significantly larger than that of iron, if any increase in the gap width, most of the magnetic flux caused by the drive coil (closing coil) 10 does not flow in the magnetic path B, but flows in the magnetic path A (the division ratio is determined from the magnetic resistances of the magnetic paths A and B). It is important that two magnetic paths exists in which the amount of change in their gap width depending on the position of the moving member 12 differs from each other, and the holding force adjusting member 15 is placed in the magnetic path in which the gap width changes depending on the position of the moving member 12.

Figure 14:
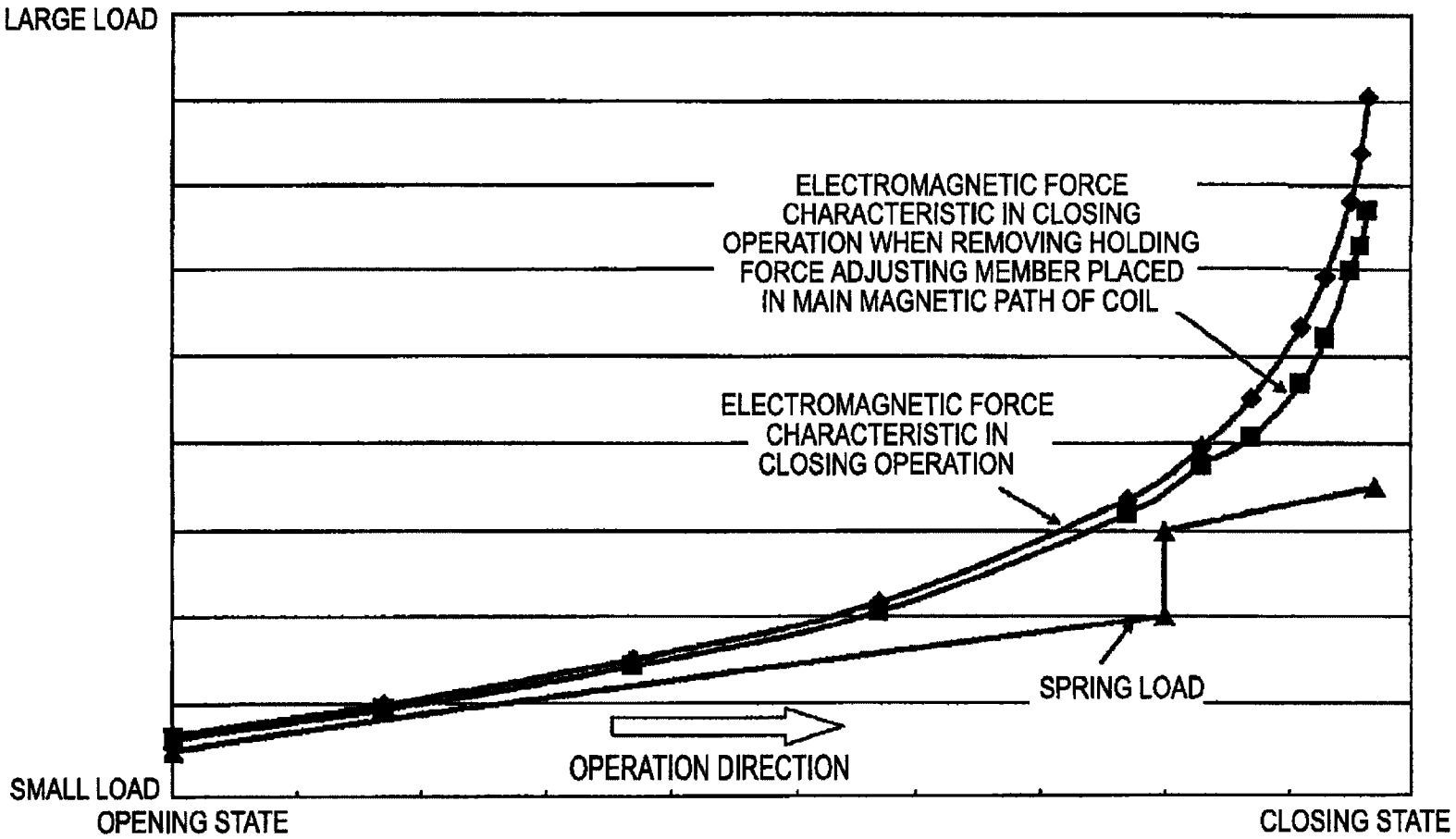
FIG. 14 A diagram showing the electromagnetic force characteristic of the electromagnetically operated device in accordance with the first to third embodiments of the invention in the closing operation.
Figure 15:
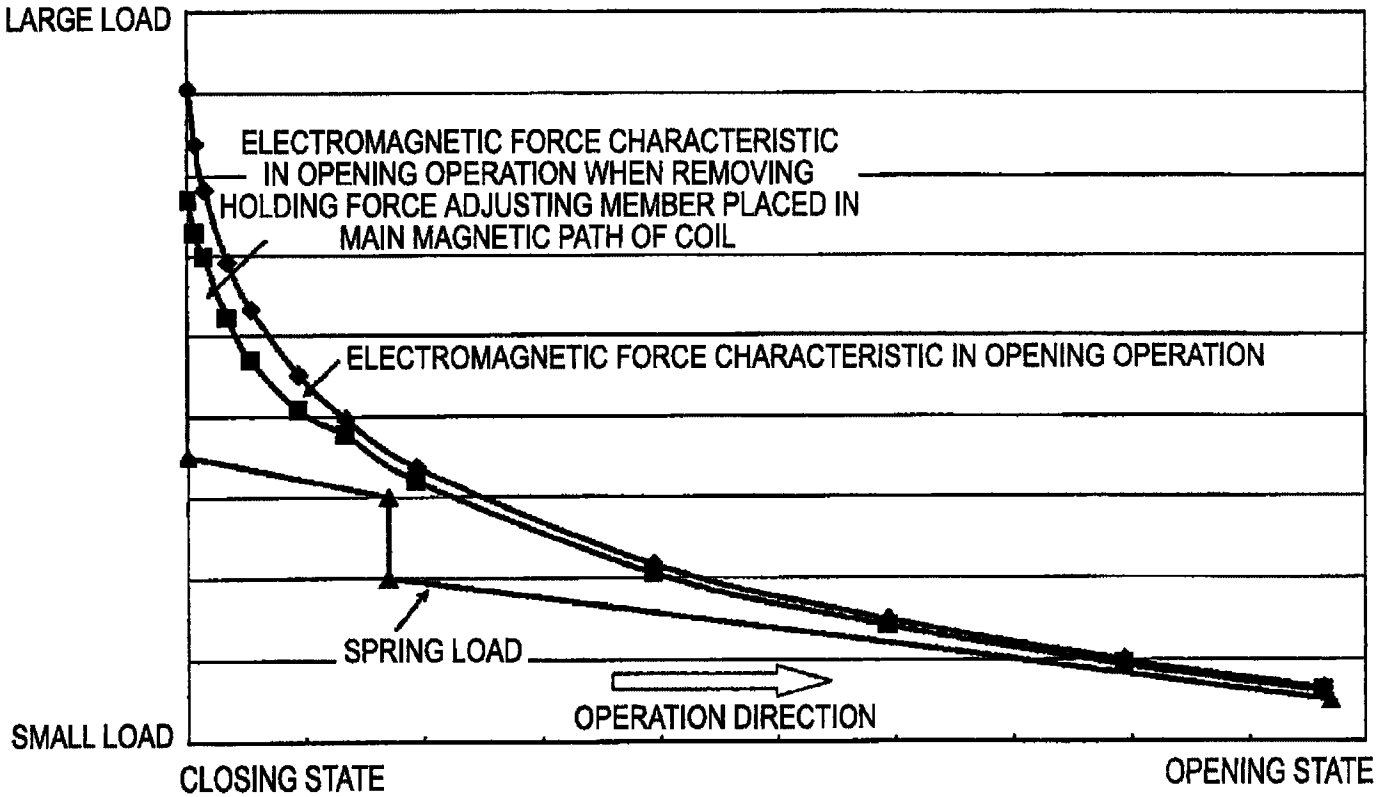
FIG. 15 A diagram showing the electromagnetic force characteristic of the electromagnetically operated device in accordance with the first to third embodiments of the invention in the opening operation.

FIG. 14 shows the electromagnetic force characteristic in the closing operation. FIG. 15 shows the electromagnetic force characteristic in the opening operation. In both the figures, the horizontal axis indicates the stroke, and the vertical axis indicates the load. If the holding force adjusting member 15 is placed at a position that will be in the main magnetic path of the drive coil (closing and opening coil) 10, the magnetic resistance along the magnetic path length may differ depending on the presence or absence of the holding force adjusting member 15, also causing the electromagnetic force characteristic to differ (as shown in FIGS. 14 and 15). If the holding force adjusting member 15 is placed in the main magnetic path, variation in the holding force can be suppressed, but the electromagnetic force characteristic may vary while the opening or closing operation is being driven, causing the opening and closing operations to vary. So, the holding force adjusting member 15 should be placed at a position that will not be included in the main magnetic path of the drive coil (closing and opening coil) 10.

Figure 16:
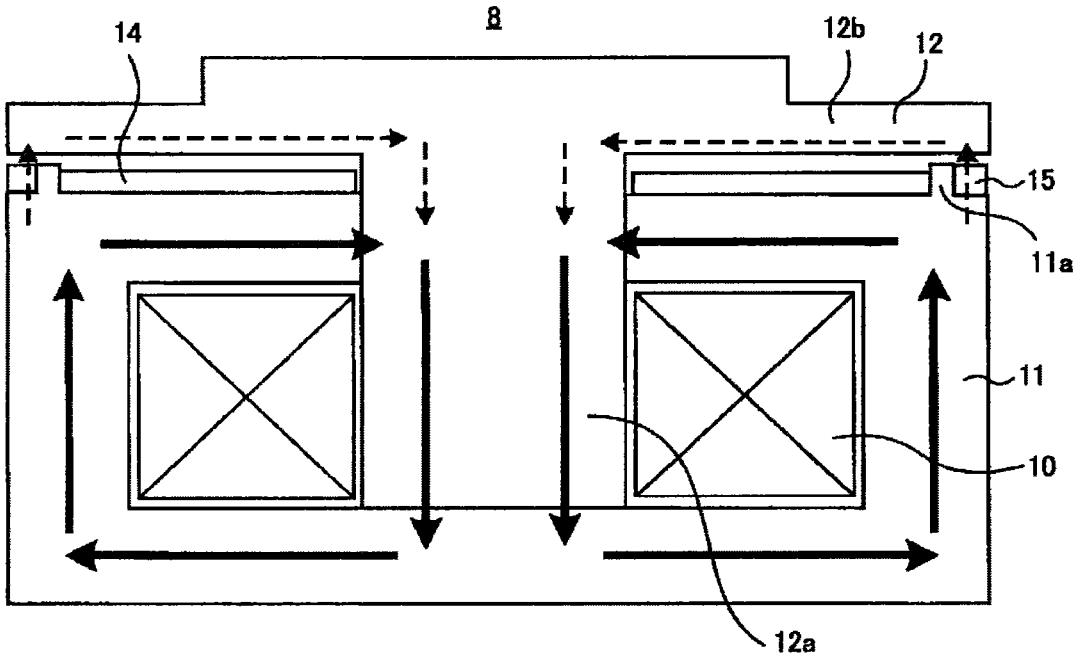
FIG. 16 A diagram showing the magnetic flux flow of the electromagnetically operated device in accordance with the first embodiment of the invention when the drive coil (closing coil) is energized with the closing operation completed.
Figure 17:
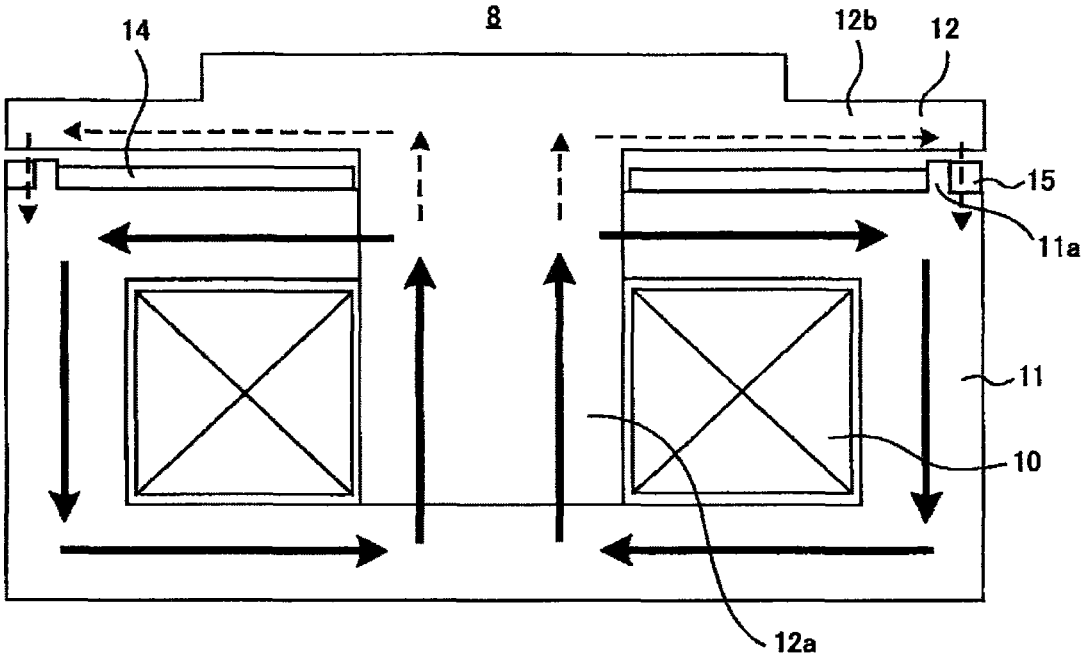
FIG. 17 A diagram showing the magnetic flux flow of the electromagnetically operated device in accordance with the first embodiment of the invention when the drive coil (opening coil) is energized with the closing operation completed.
Figure 18:
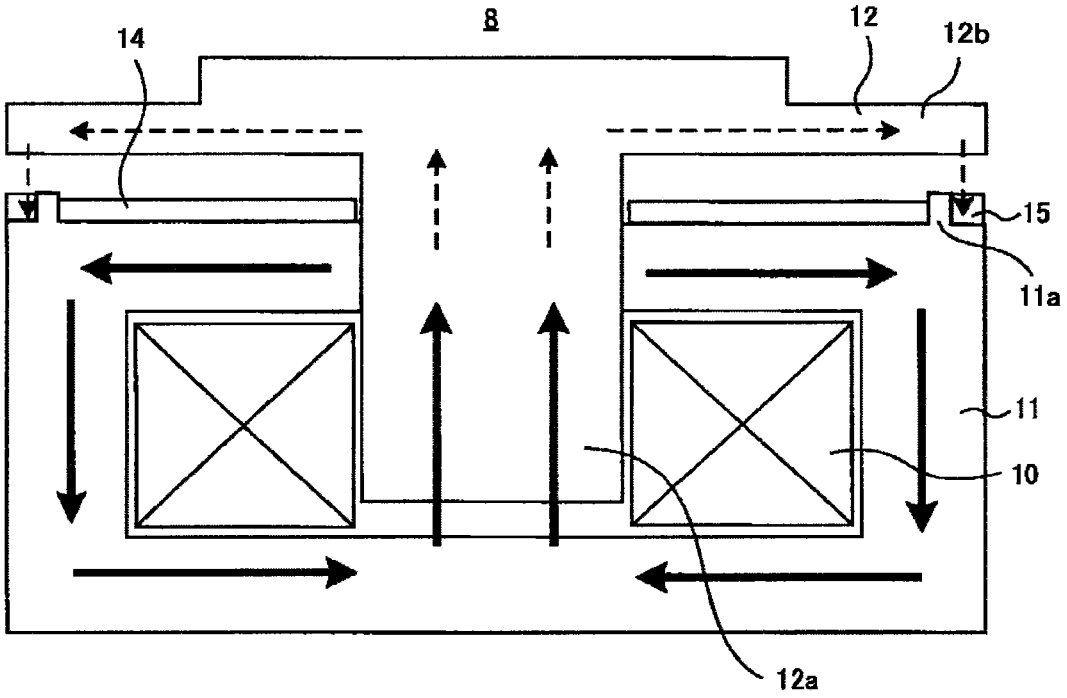
FIG. 18 A diagram showing the magnetic flux flow of the electromagnetically operated device in accordance with the first embodiment of the invention when the drive coil (opening coil) is energized with the opening operation being performed.

With the holding force adjusting member 15 placed at a position that will not be included in the main magnetic path of the magnetic flux caused by the drive coil (closing and opening coil) 10, removing or changing the shape of the holding force adjusting member 15 is less likely to affect the opening and closing operations. FIG. 16 shows the magnetic flux flow when the closing operation is completed. Even in the closing state, the holding force adjusting member 15 is not in the main magnetic path. Similarly, FIGS. 17 and 18 show the magnetic flux flow when the drive coil (closing and opening coil) 10 is energized. Similarly to the closing operation, also while the opening operation is being driven, the holding force adjusting member 15 is not in the main magnetic path of the magnetic flux caused by the drive coil (closing and opening coil) 10.

In both the opening and closing operations, the magnetic flux generated by the drive coil (closing and opening coil) 10 does not pass through the permanent magnet 14, so the amount of demagnetization caused by the magnetic flux generated by the coil (closing and opening coil) 10 is very small. Furthermore, the holding force adjusting member 15 may be configured in bulk because, in closing state, the magnetic flux of the permanent magnet 14 passes through the holding force adjusting member 15 (the magnetic flux of the permanent magnet 14 does not change with time and so eddy current does not occur). Generally, an iron core used for the electromagnetically operated device is configured by laminating electromagnetic steel sheets in order to suppress eddy current. However, since the amount of eddy current occurring in the holding force adjusting member 15 through which small amount of time-varying magnetic flux caused by the drive coil (closing and opening coil) 10 passes is small, the holding force adjusting member is not required to be configured by laminating the electromagnetic steel sheets and may be configured in bulk. Since the holding force adjusting member 15 is configured to be removable, configuring in bulk facilitates the machining of the mounting part in comparison with configuring by laminating electromagnetic steel sheets. However, even when the holding force adjusting member 15 is configured by laminating electromagnetic steel sheets, the invention provides the same effect. Furthermore, the first embodiment is described taking the vacuum circuit breaker as an example, but the first embodiment is not limited to the vacuum circuit breaker.

Second Embodiment

Next, an electromagnetically operated device and a switching device including the electromagnetically operated device in accordance with a second embodiment of the invention is described.

Figure 19:
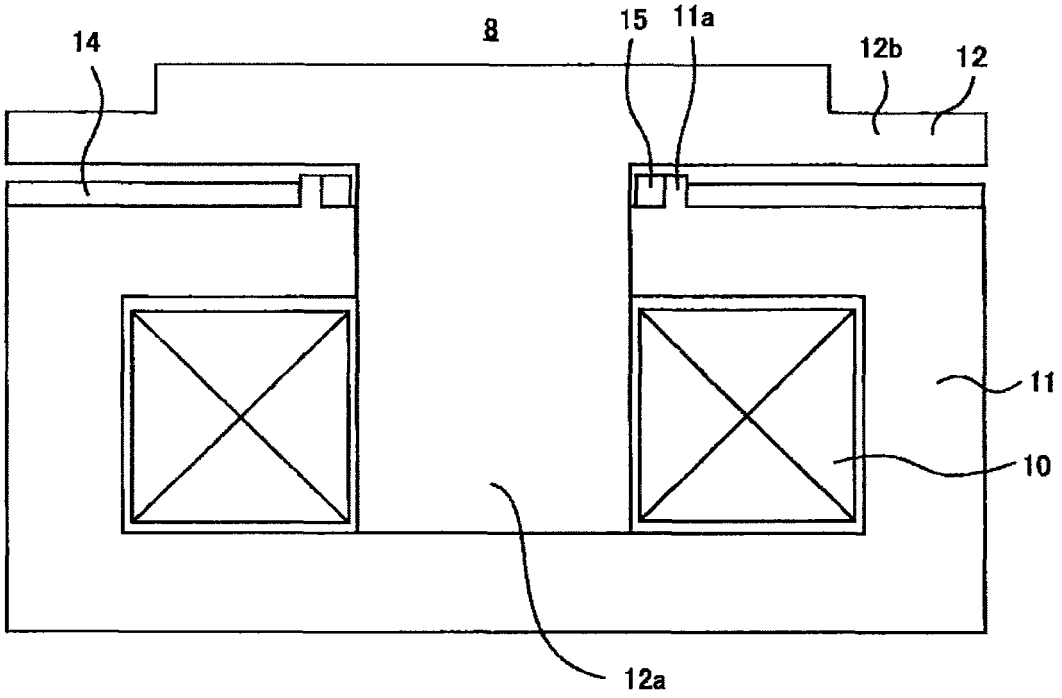
FIG. 19 A front view showing an electromagnetically operated device in accordance with a second embodiment of the invention.

FIG. 19 is a configuration diagram showing the electromagnetically operated device in accordance with the second embodiment. An electromagnetically operated device 8 in accordance with the second embodiment includes a holding force adjusting member 15 placed at the inside magnetic pole of a permanent magnet 14.

Note that the remaining parts are configured in the same way as the first embodiment and so are denoted by the same numerals with their description omitted.

Figure 20:
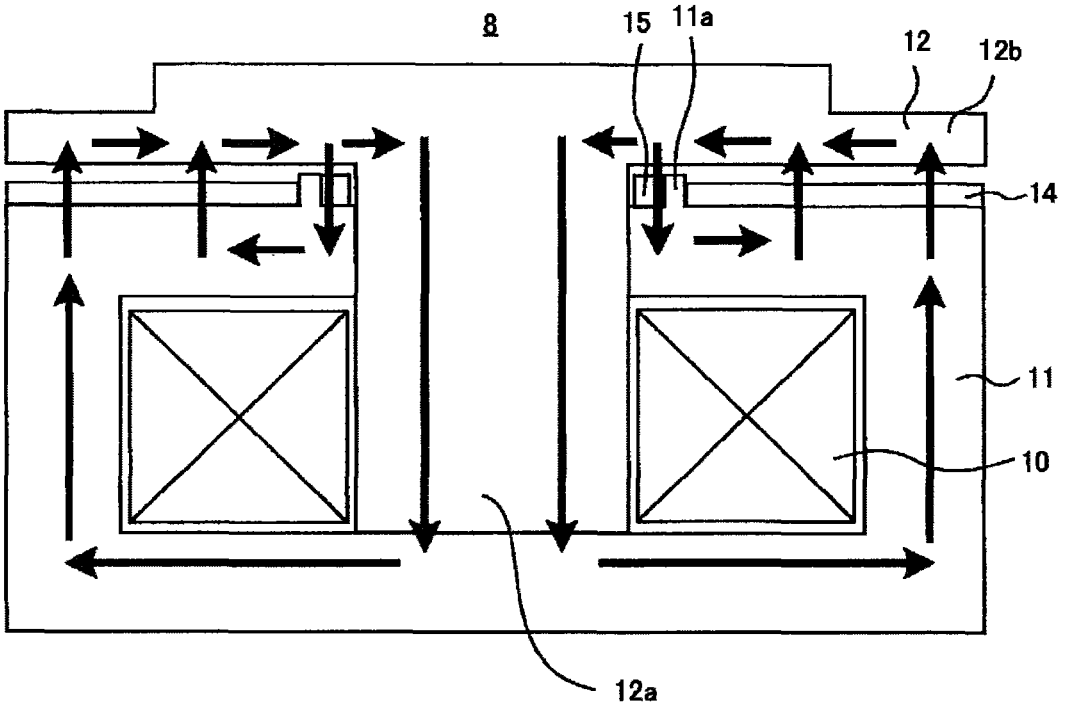
FIG. 20 A diagram showing the magnetic flux flow of a permanent magnet of the electromagnetically operated device in accordance with the second embodiment of the invention.
Figure 21:
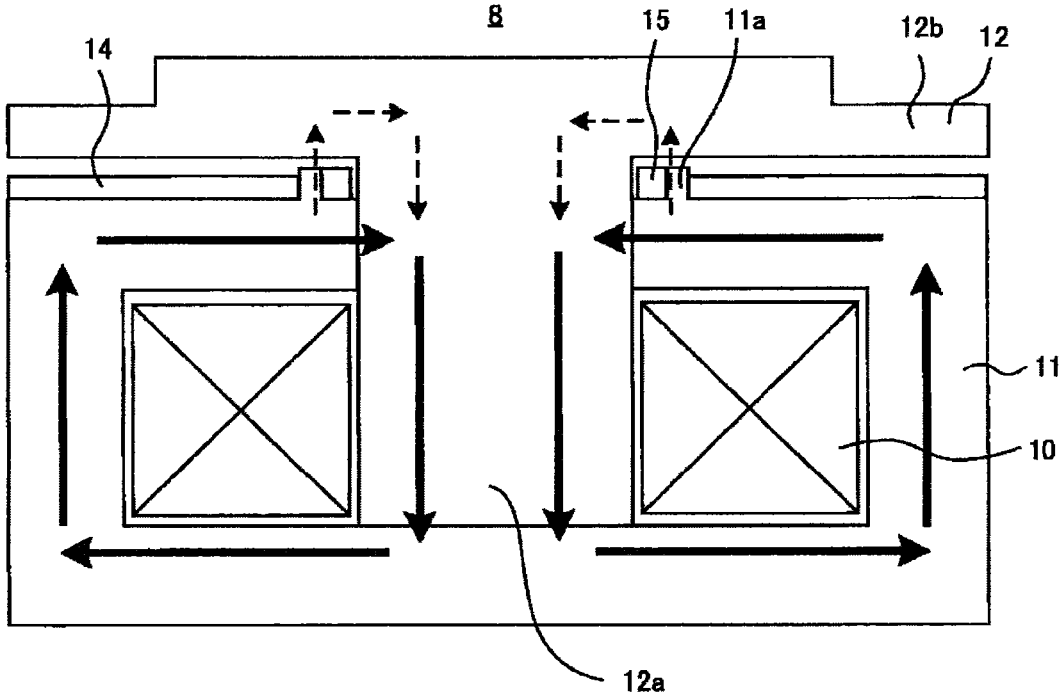
FIG. 21 A diagram showing the magnetic flux flow of the electromagnetically operated device in accordance with the second embodiment of the invention when the drive coil (closing coil) is energized with the closing operation completed.
Figure 22:
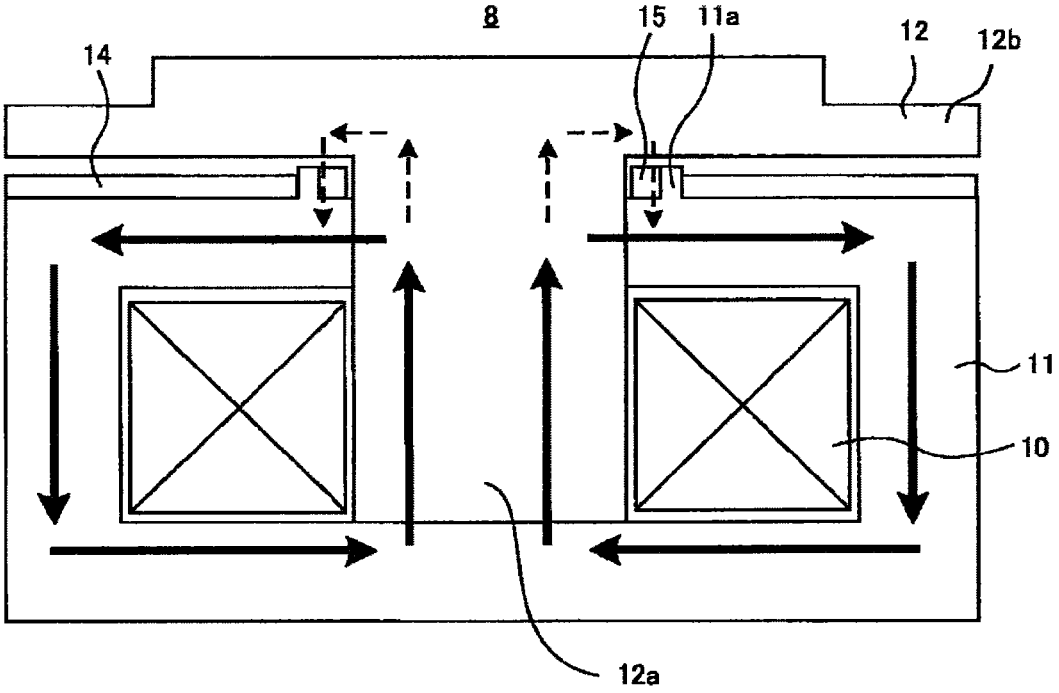
FIG. 22 A diagram showing the magnetic flux flow of the electromagnetically operated device in accordance with the second embodiment of the invention when the drive coil (opening coil) is energized with the closing operation completed.

FIG. 20 shows the magnetic flux flow of the permanent magnet 14 in the closing state. FIG. 21 shows the magnetic flux flow when a drive coil (closing coil) 10 is energized in the closing state. FIG. 22 shows the magnetic flux flow when the drive coil (opening coil) 10 is energized in the opening state. Among the magnetic flux vectors caused by the drive coil (closing and opening coil) 10, solid arrows indicate the main magnetic path and dotted arrows do not indicate the main magnetic path. An effect of placing the holding force adjusting member 15 as part of the inside magnetic pole of the permanent magnet 14 is the same as that of placing at the outside in the first embodiment.

Third Embodiment

Next, an electromagnetically operated device and a switching device including the electromagnetically operated device in accordance with a third embodiment of the invention is described.

Figure 23:
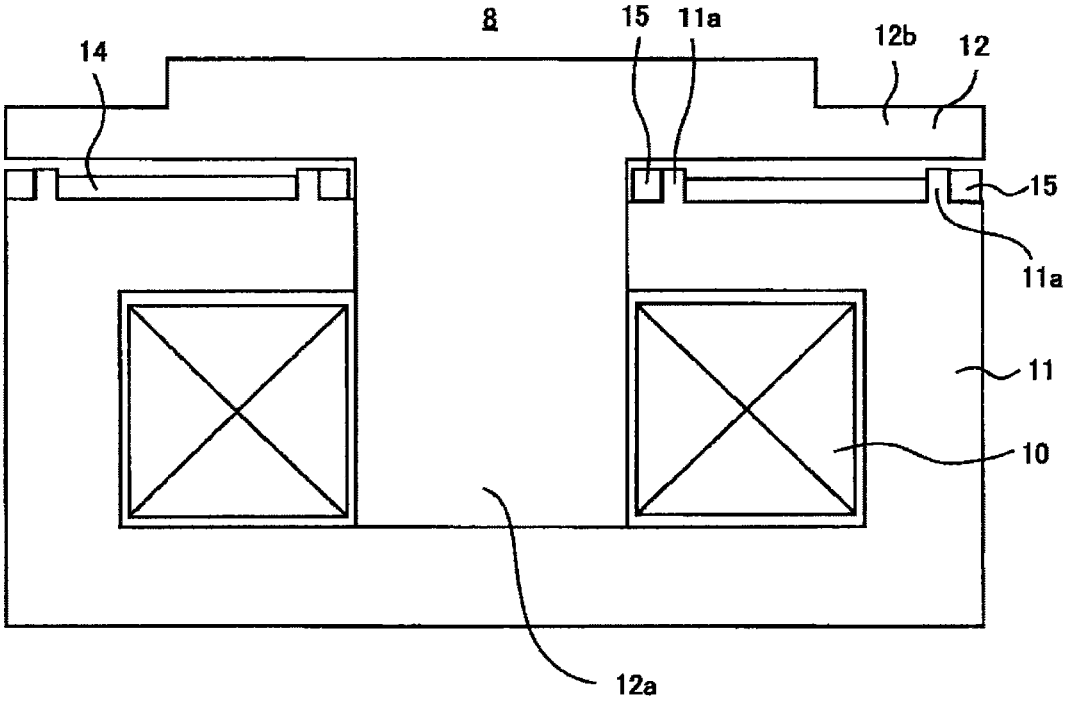
FIG. 23 A front view showing an electromagnetically operated device in accordance with a third embodiment of the invention.

FIG. 23 is a configuration diagram showing the electromagnetically operated device in accordance with the third embodiment. An electromagnetically operated device 8 in accordance with the third embodiment includes a holding force adjusting member 15 placed at both the inside magnetic pole and the outside magnetic pole of a permanent magnet 14. Note that the remaining parts are configured in the same way as the first embodiment and so are denoted by the same numerals with their description omitted.

Figure 24:
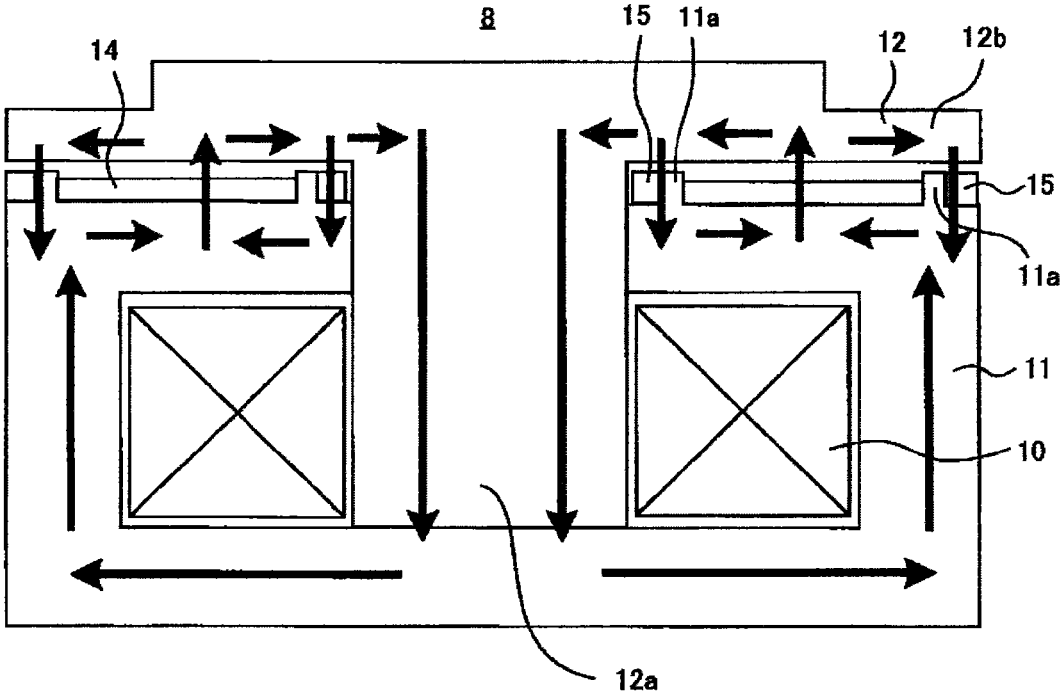
FIG. 24 A diagram showing the magnetic flux flow of a permanent magnet of the electromagnetically operated device in accordance with the third embodiment of the invention.
Figure 25:
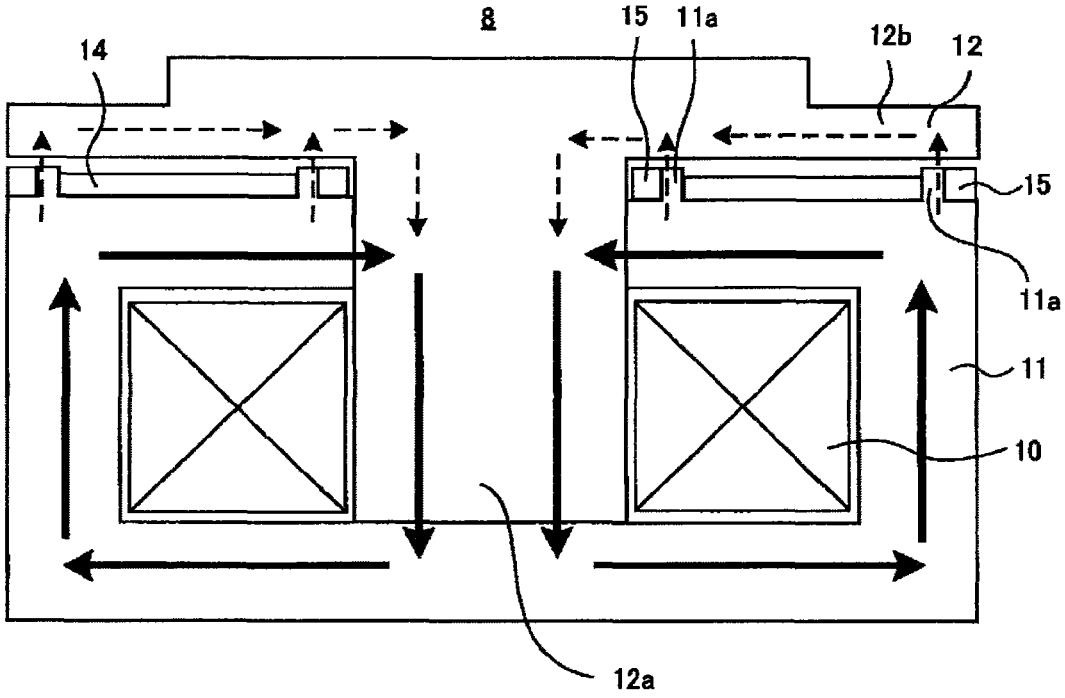
FIG. 25 A diagram showing the magnetic flux flow of the electromagnetically operated device in accordance with the third embodiment of the invention when the drive coil (closing coil) is energized with the closing operation completed.
Figure 26:
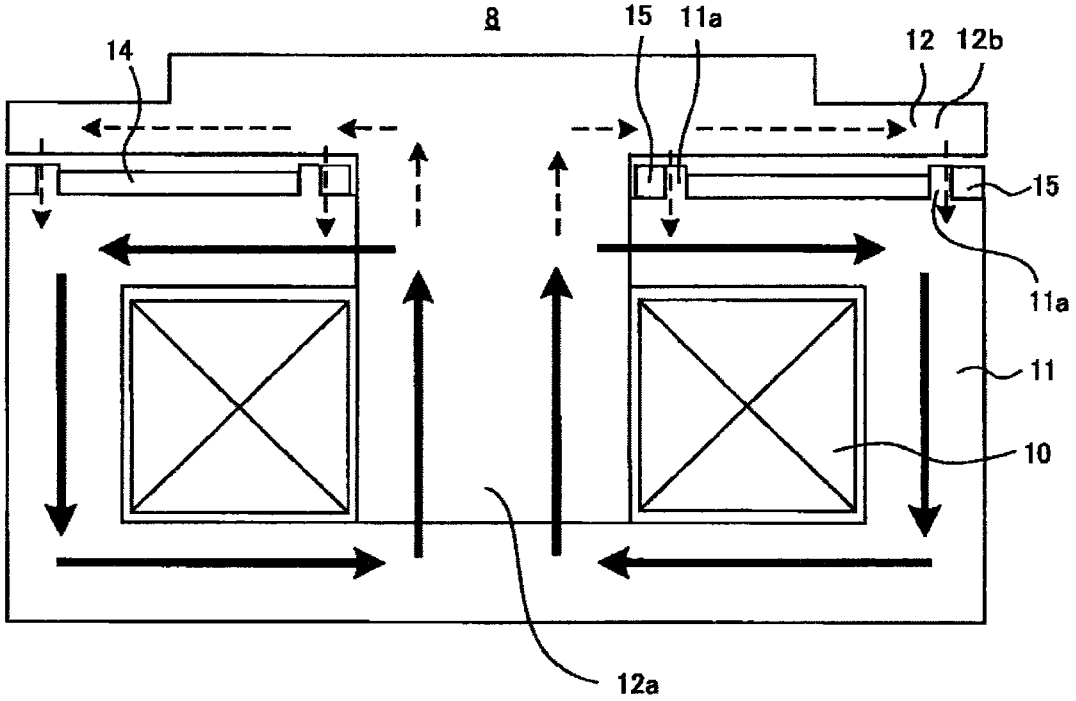
FIG. 26 A diagram showing the magnetic flux flow of the electromagnetically operated device in accordance with the third embodiment of the invention when the drive coil (opening coil) is energized with the closing operation completed.

FIG. 24 shows the magnetic flux flow of the permanent magnet 14 in the closing state. FIG. 25 shows the magnetic flux flow when a drive coil (closing coil) 10 is energized in the closing state. FIG. 26 shows the magnetic flux flow when the drive coil (opening coil) 10 is energized in the opening state. Among the magnetic flux vectors caused by the drive coil (closing and opening coil) 10, solid arrows indicate the main magnetic path and dotted arrows do not indicate the main magnetic path. An effect of placing the holding force adjusting member 15 at both the inside magnetic pole and the outside magnetic pole of a permanent magnet 14 is to enable the holding force adjustment at two positions in the inside and two positions in the outside (four positions in the both ends), which increases the range of the holding force that can be adjusted using the holding force adjusting member 15.

Figure 27:
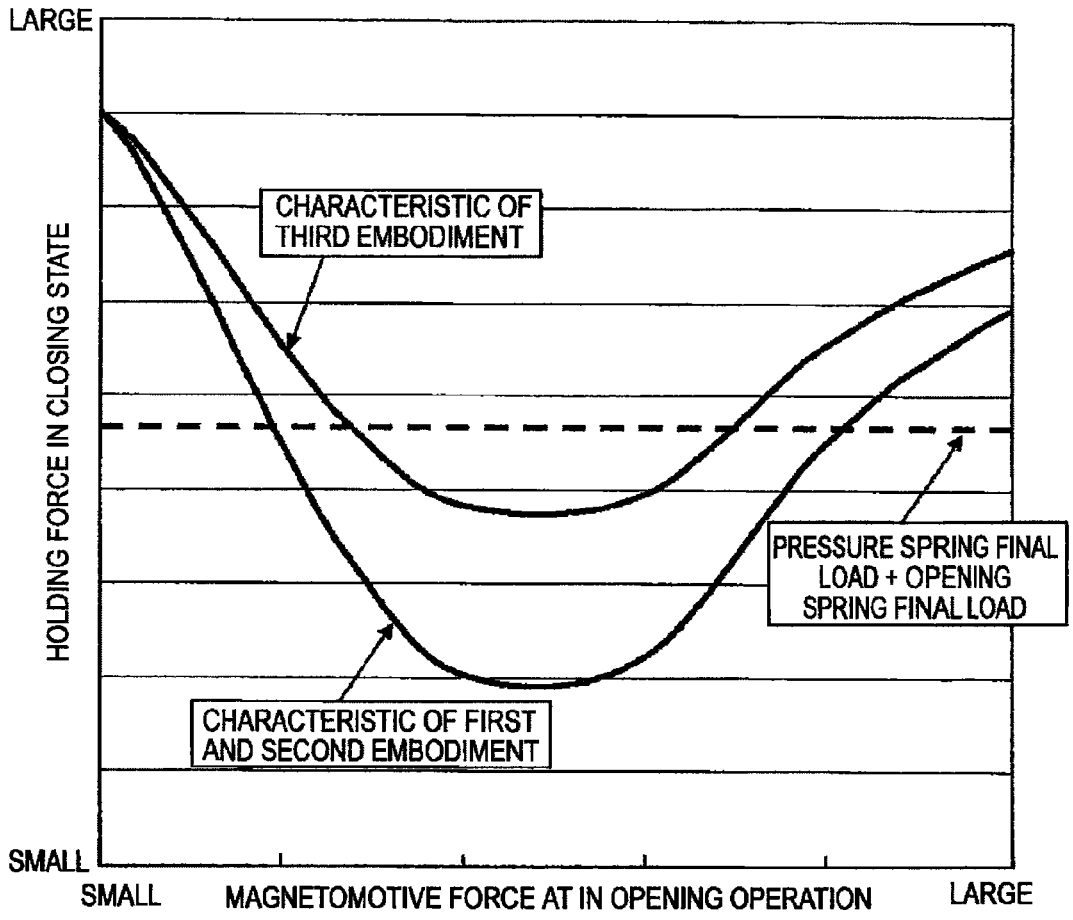
FIG. 27 A diagram showing the holding force characteristic of the electromagnetically operated device in accordance with the first to third embodiments of the invention when the drive coil (opening coil) is energized.

FIG. 27 shows an example of the holding force characteristic when the drive coil (opening coil) 10 is energized in the closing state in the first to third embodiments. As described in the first embodiment, the holding force occurs at three point, that is, from the moving member center portion 12*a* to the stationary member 11, from the moving member opposite portion 12*b* to the stationary member 11 (including the holding force adjusting member 15) and from the permanent magnet 14 to the moving member opposite portion 12*b*. On the other hand, the magnetic flux caused by the drive coil (opening coil) 10 cancels only the magnetic flux from the moving member center portion 12*a* to the stationary member 11, but cannot completely cancel the magnetic flux from the moving member opposite portion 12*b* to the stationary member 11 (including the holding force adjusting member 15) and from the permanent magnet 14 to the moving member opposite portion 12*b*. Accordingly, the holding force characteristic when the drive coil (opening coil) 10 is energized varies depending on the structure (embodiment) of the electromagnetically operated device 8. Here, for comparison purpose, the holding force when the drive coil (opening coil) 10 is not energized is assumed to be constant.

First, placing the magnetic pole including the holding force adjusting member 15 on the both ends of the permanent magnet 14 as in the third embodiment makes the percentage of the holding force from the moving member opposite portion 12*b* to the stationary member 11 (including the holding force adjusting member 15) larger than that of the first embodiment or the second embodiment. As a result, the percentage of the holding force that cannot be canceled by the drive coil (opening coil) 10 increases.

On the other hand, in the structure of the first or second embodiment, placing the magnetic pole including the holding force adjusting member 15 only on the one side of the permanent magnet 14 decreases the percentage of the holding force that cannot be canceled by the drive coil (opening coil) 10. The decrease in the percentage of the holding force that cannot be canceled by the drive coil (opening coil) 10 means that the holding force that can be canceled by the same magnetomotive force (AT) increases and then the magnetomotive force required for making the holding force less than or equal to the total amount of the final loads of the pressure spring 7 and the opening spring 13 can be reduced. The above can be summarized as follows.

In the first and second embodiments, the adjustable range of the holding force is smaller than that of the third embodiment, but the magnetomotive force required for the opening operation can be smaller. In contrast, in the third embodiment, the magnetomotive force required for the opening operation is larger than that of the first and second embodiment, but the adjustable range of the holding force is larger. Utilizing these characteristics to use a different type of the electromagnetically operated device 8 depending on the configuration of the vacuum circuit breaker 1 can provide an optimum configuration of the electromagnetically operated switching device.

Fourth Embodiment

Next, an electromagnetically operated device and a switching device including the electromagnetically operated device in accordance with a fourth embodiment of the invention is described.

Figure 28:
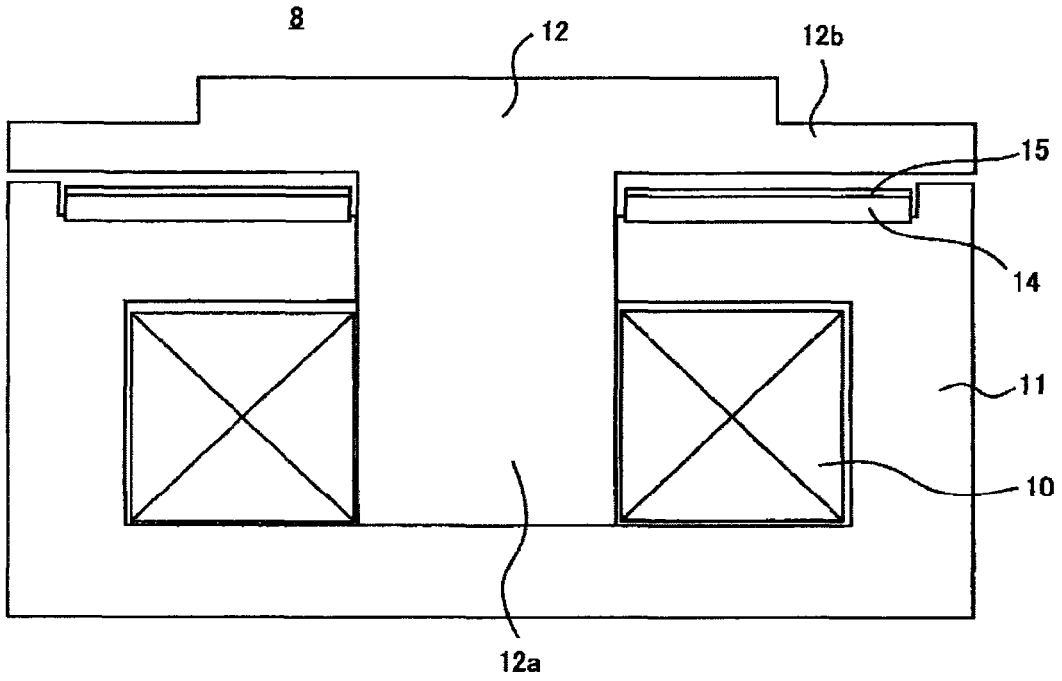
FIG. 28 A front view showing an electromagnetically operated device in accordance with a fourth embodiment of the invention.

FIG. 28 is a configuration diagram showing the electromagnetically operated device in accordance with the fourth embodiment. An electromagnetically operated device 8 in accordance with the fourth embodiment includes a holding force adjusting member 15 placed on a permanent magnet 14.

Note that the remaining parts are configured in the same way as the first embodiment and so are denoted by the same numerals with their description omitted.

Figure 29:
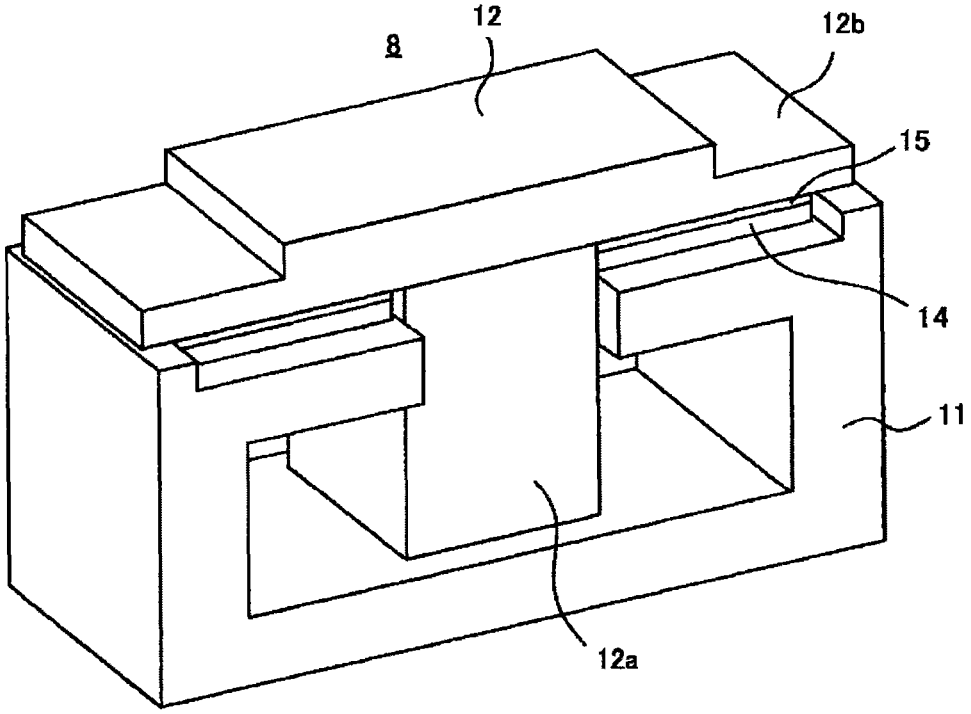
FIG. 29 A perspective view showing the electromagnetically operated device in accordance with the fourth embodiment of the invention.
Figure 30:
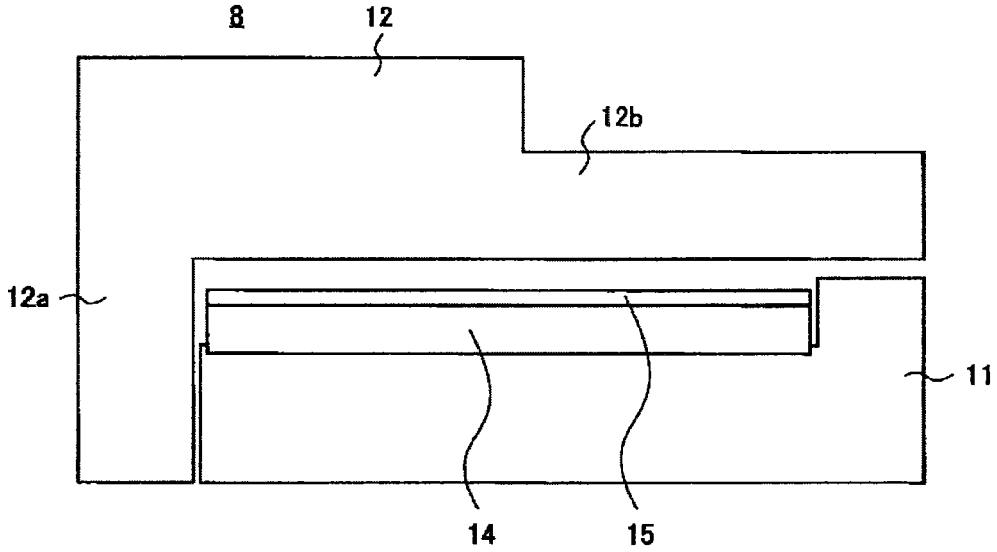
FIG. 30 An enlarged view of a moving member opposite portion of the electromagnetically operated device in accordance with the fourth embodiment of the invention.
Figure 31:
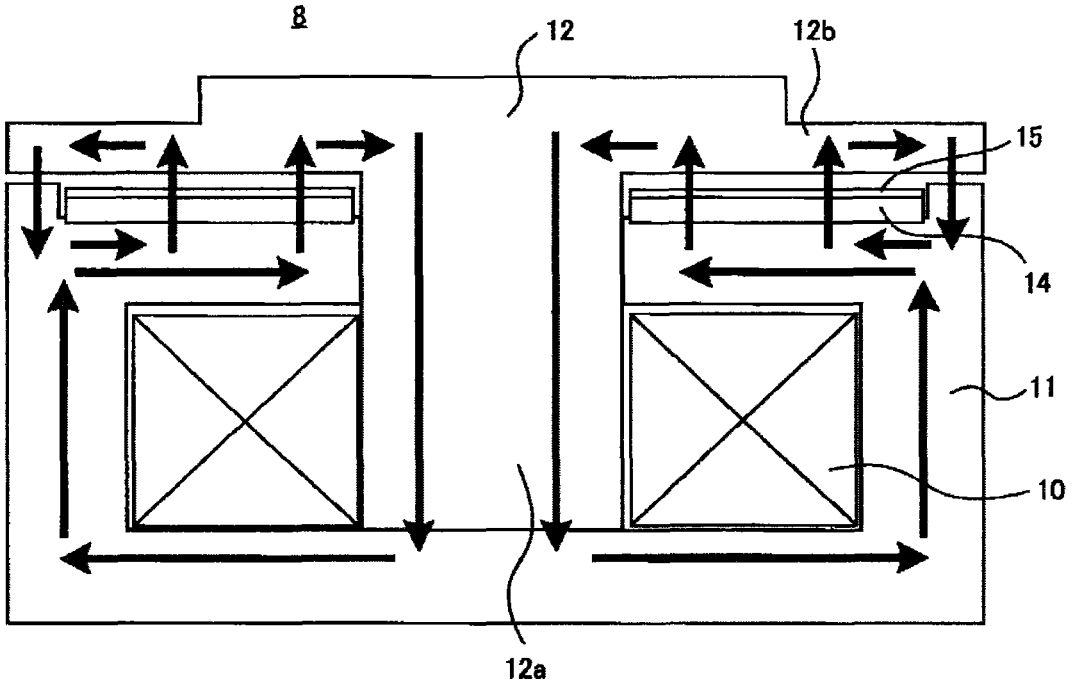
FIG. 31 A diagram showing the magnetic flux flow of a permanent magnet of the electromagnetically operated device in accordance with the fourth embodiment of the invention.

FIG. 29 is a perspective view of FIG. 28. FIG. 30 is an enlarged view of the surfaces of the moving member 12 and the permanent magnet 14 opposite to each other. FIG. 31 shows the magnetic flux flow of the permanent magnet 14 in the closing state. Similarly to the first embodiment, the magnetic flux of the permanent magnet 14 forms three flux flows, that is, a flux flow from a moving member center portion 12*a* to a stationary member 11 a flux flow from a moving member opposite portion 12*b* to the stationary member 11 and a flux flow from the permanent magnet 14 (including the holding force adjusting member 15) to the moving member 12 to generate the holding force on the moving member 12.

Figure 32:
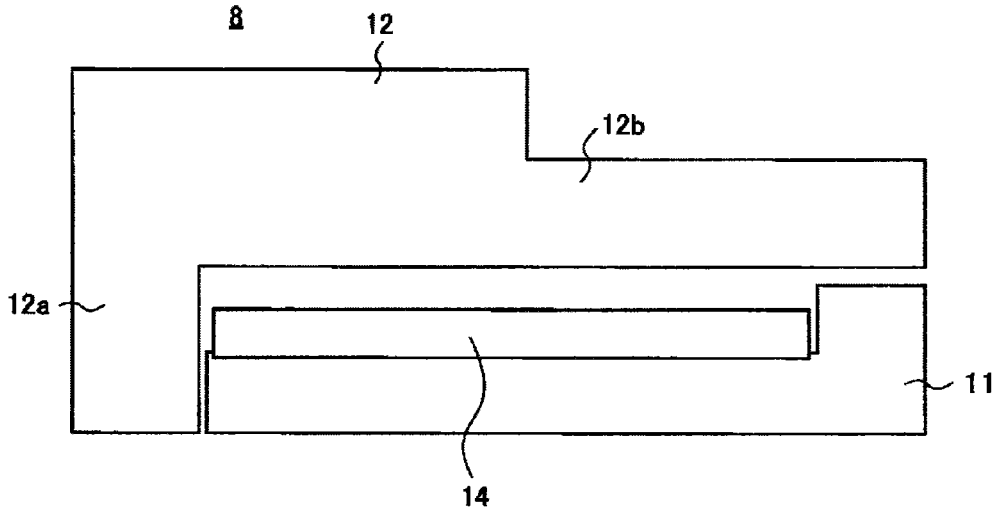
FIG. 32 An enlarged view of the moving member opposite portion of the electromagnetically operated device in accordance with the fourth embodiment of the invention with a holding force adjusting member removed.
Figure 33:
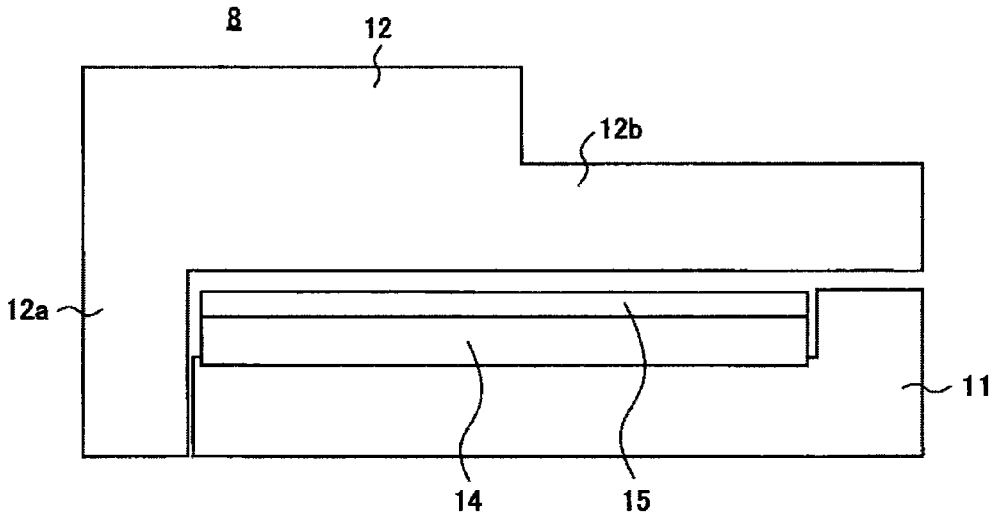
FIG. 33 An enlarged view of the moving member opposite portion of the electromagnetically operated device in accordance with the fourth embodiment of the invention with the thickness of the holding force adjusting member increased.

FIG. 32 is a diagram in which the holding force adjusting member 15 is removed from the electromagnetically operated device 8. FIG. 33 is a diagram in which the height of the holding force adjusting member 15 is increased. For the holding force adjusting member 15, not only the cross-sectional area but also the width of the gap with the moving member 12 can be adjusted. This applies to all of the above-described embodiments. Depending on the presence or absence of the holding force adjusting member 15, with the same magnetic flux flow as FIG. 31, the width of the gap between the moving member 12 and the permanent magnet 14 varies, and the total amount of the magnetic flux caused by the permanent magnet 14 varies, then the holding force increases or decreases. The holding force adjusting member 15 may be in any appropriate shape as long as it has a structure in which dimensions in the height direction, lateral direction and thickness direction can be individually changed to change the cross-sectional area and the width of the gap with the moving member 12. However, the height of the holding force adjusting member 15 needs to be adjusted so that a gap will exist between the holding force adjusting member 15 and the moving member 12 even in the closing state. When the holding force adjustment is required as a result of measuring the holding force, all what needs to be done is to widen the gap between the permanent magnet 14 and the moving member 12 and replace or remove the holding force adjusting member 15 on the permanent magnet 14, which can reduce the time for adjusting the holding force.

Figure 34:
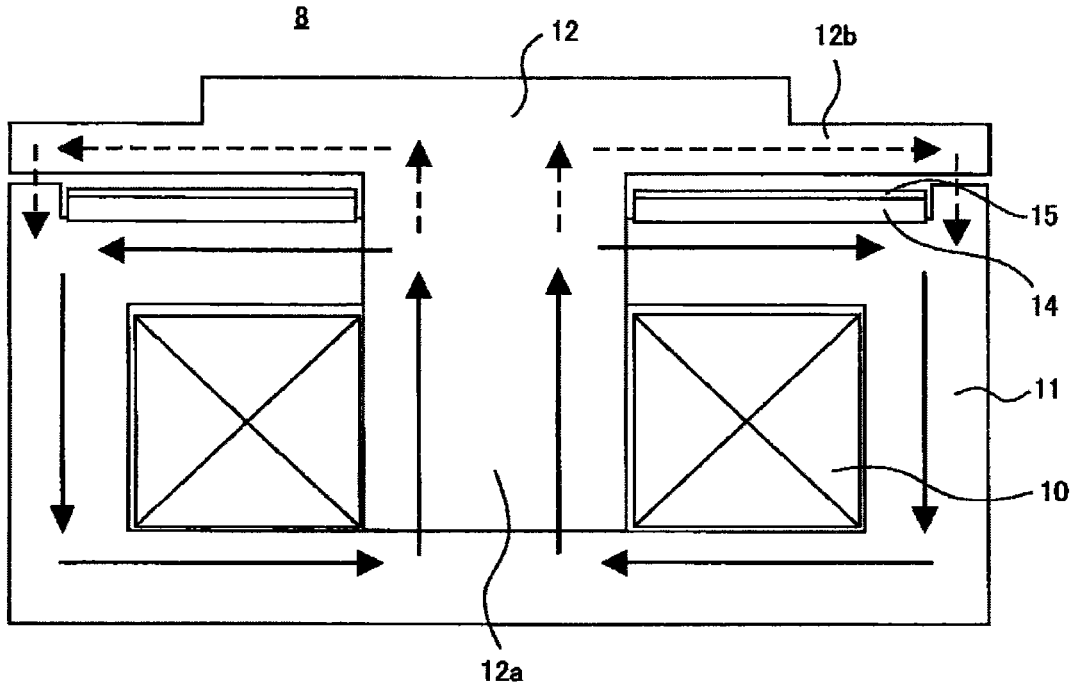
FIG. 34 A diagram showing the magnetic flux flow caused by an opening coil of the electromagnetically operated device in accordance with the fourth embodiment of the invention when the opening coil is energized in the closing state.
Figure 35:
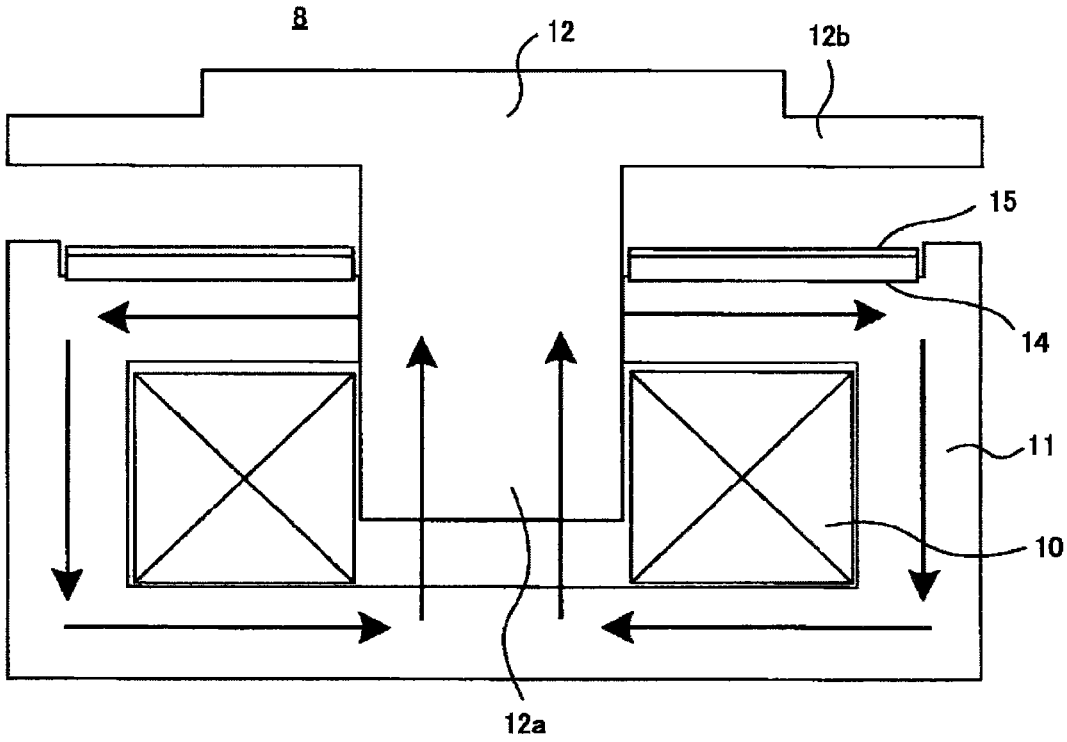
FIG. 35 A diagram showing the magnetic flux flow caused by the opening coil of the electromagnetically operated device in accordance with the fourth embodiment of the invention when the opening coil is energized with the opening operation being performed.
Figure 36:
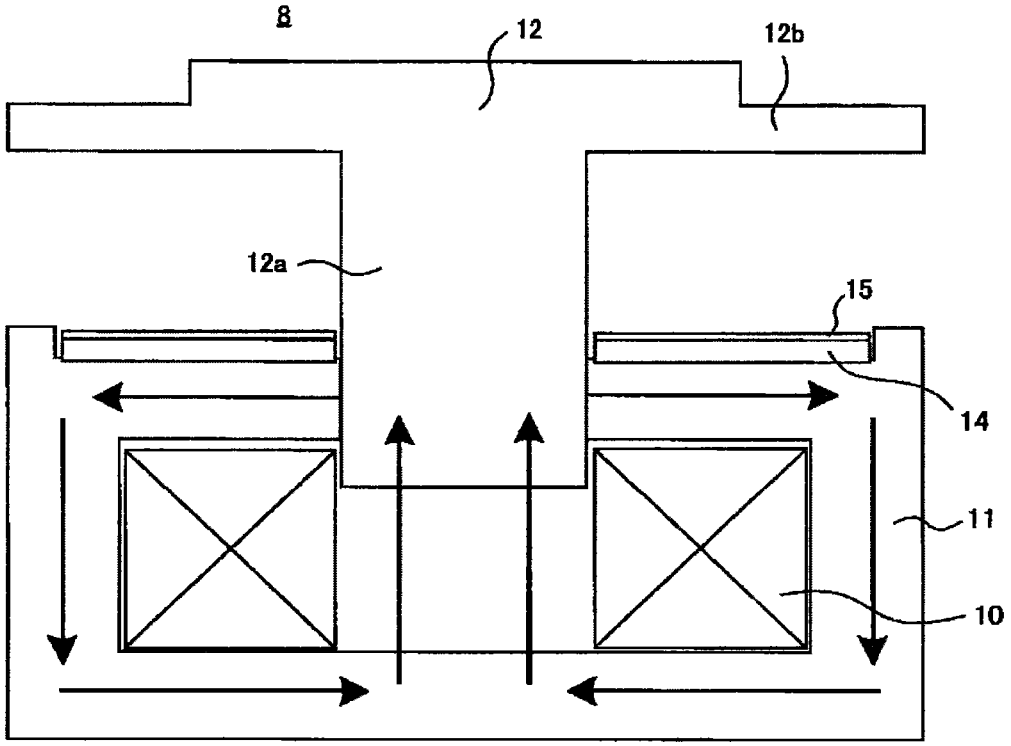
FIG. 36 A diagram showing the magnetic flux flow caused by the opening coil of the electromagnetically operated device in accordance with the fourth embodiment of the invention when the opening coil is energized in the opening state.
Figure 37:
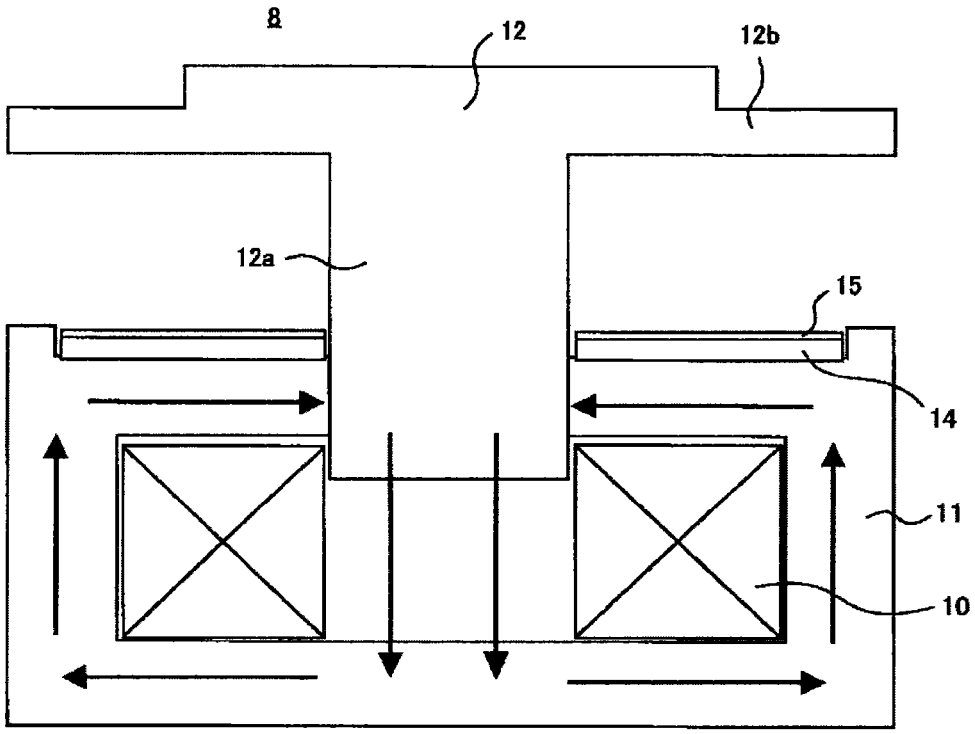
FIG. 37 A diagram showing the magnetic flux flow caused by a closing coil of the electromagnetically operated device in accordance with the fourth embodiment of the invention when the closing coil is energized in the opening state.
Figure 38:
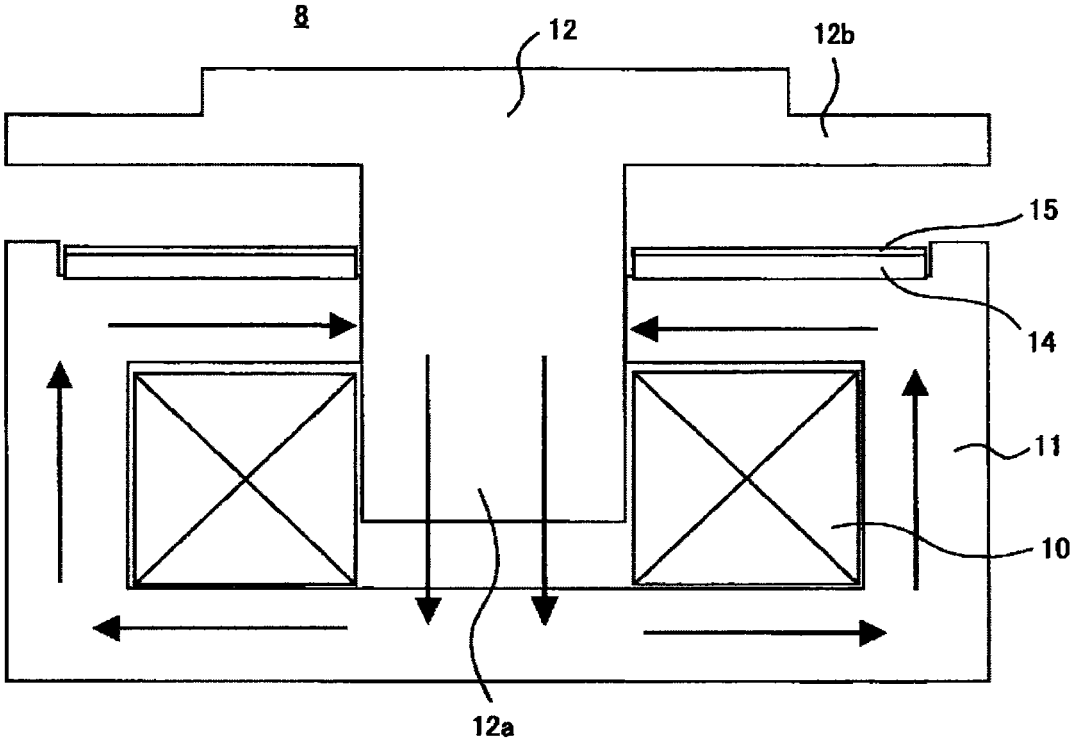
FIG. 38 A diagram showing the magnetic flux flow caused by the closing coil of the electromagnetically operated device in accordance with the fourth embodiment of the invention when the closing coil is energized in the opening state.
Figure 39:
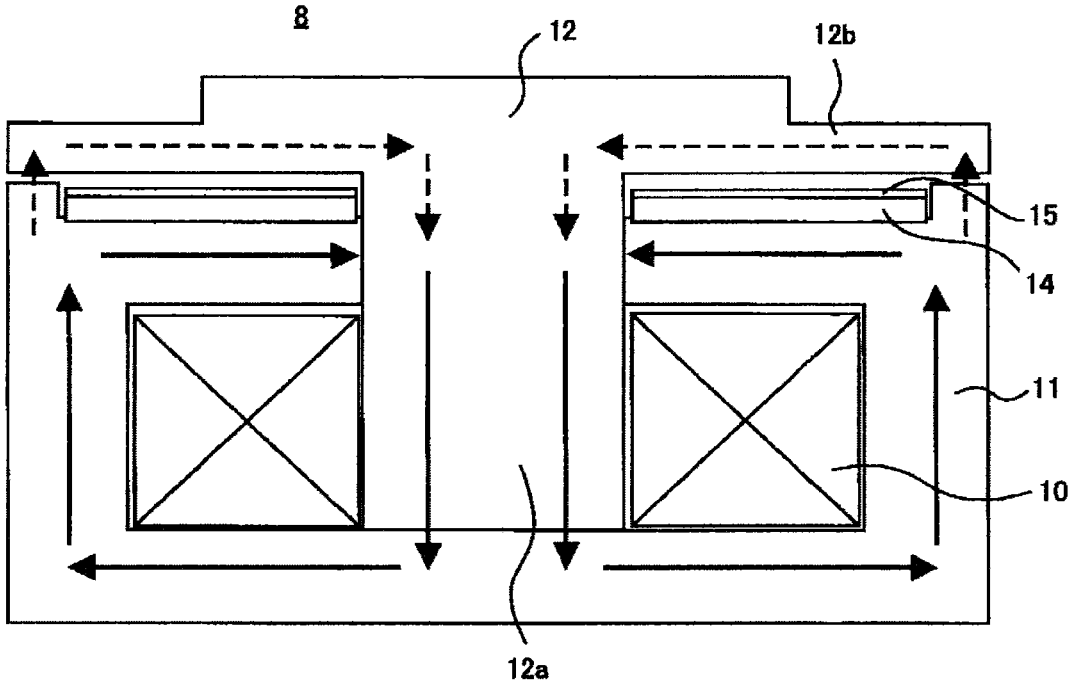
FIG. 39 A diagram showing the magnetic flux flow caused by the closing coil of the electromagnetically operated device in accordance with the fourth embodiment of the invention when the closing coil is energized in the closing state.

The magnetic flux flow when the drive coil is energized is described below. FIGS. 34, 35 and 36 shows the magnetic flux flow in the closing state, when the drive coil (opening coil) 10 is energized, and in the opening state. FIGS. 37, 38 and 39 shows the magnetic flux flow caused by the coil in the opening state, when the drive coil (closing coil) 10 is energized, and in the closing state. Since the magnetic resistance of the permanent magnet 14 is almost equal to that of the gap, the magnetic flux caused by the drive coil (closing coil) 10 and the drive coil (opening coil) 10 does not pass through the permanent magnet 14. Furthermore, in both the opening and closing operations, the magnetic flux generated by the drive coil 10 does not pass through the permanent magnet 14, so the amount of demagnetization caused by the magnetic flux generated by the coil 10 is very small. The small amount of demagnetization of the permanent magnet 14 means small amount of variation in the holding force due to time degradation of the permanent magnet 14 after product shipment.

Fifth Embodiment

Next, an electromagnetically operated device and a switching device including the electromagnetically operated device in accordance with a fifth embodiment of the invention is described.

Figure 40:
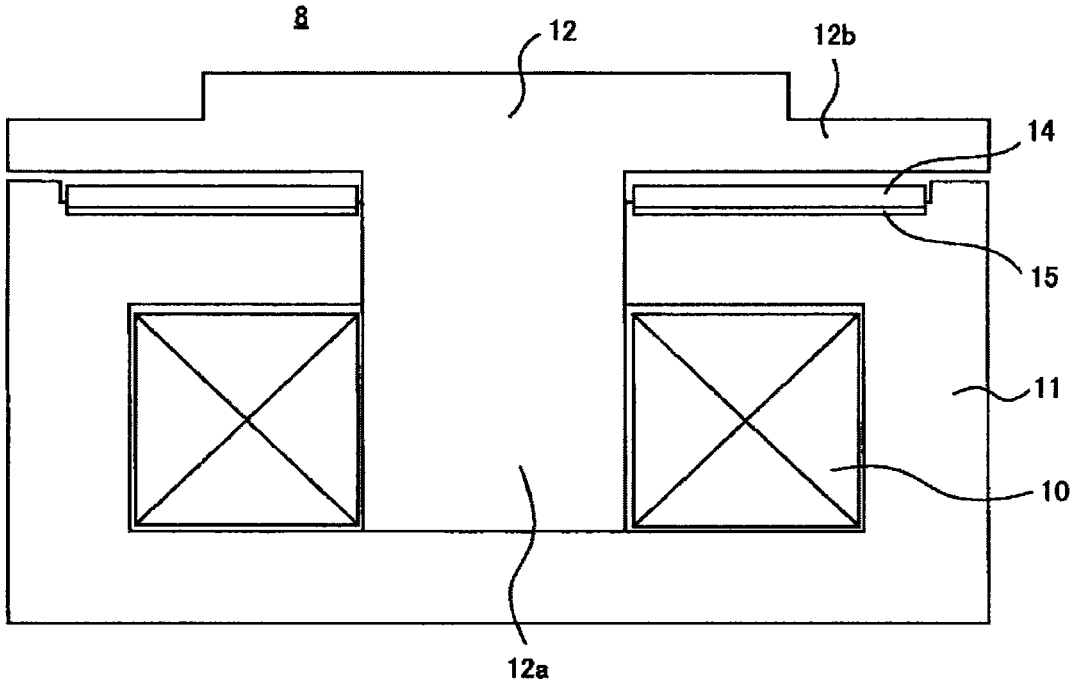
FIG. 40 A front view showing an electromagnetically operated device in accordance with a fifth embodiment of the invention.

FIG. 40 is a configuration diagram showing the electromagnetically operated device in accordance with the fifth embodiment. An electromagnetically operated device 8 in accordance with the fifth embodiment includes a holding force adjusting member 15 placed on the underside of a permanent magnet 14.

Note that the remaining parts are configured in the same way as the first embodiment and so are denoted by the same numerals with their description omitted.

Figure 41:
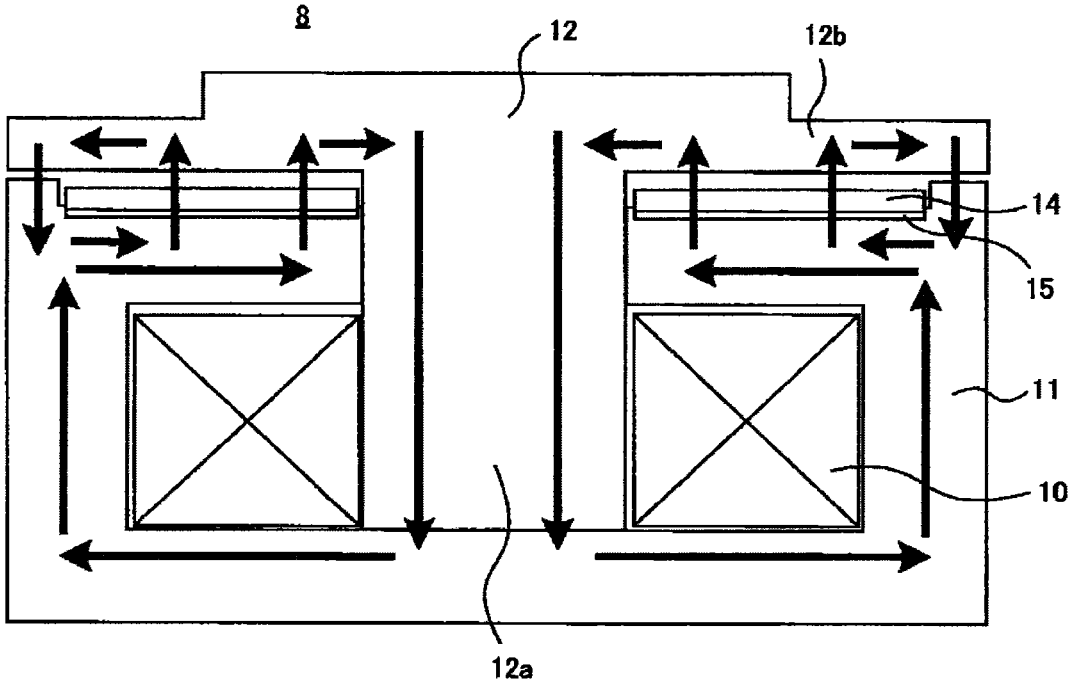
FIG. 41 A diagram showing the magnetic flux flow of a permanent magnet of the electromagnetically operated device in accordance with the fifth embodiment of the invention.
Figure 42:
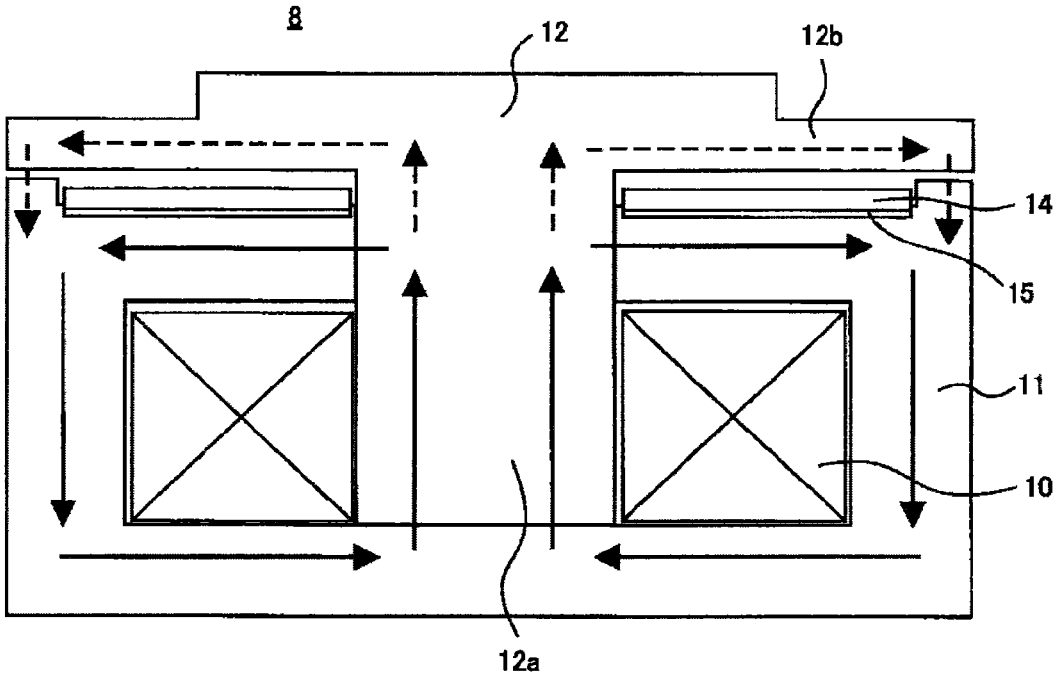
FIG. 42 A diagram showing the magnetic flux flow caused by an opening coil of the electromagnetically operated device in accordance with the fifth embodiment of the invention when the opening coil is energized in the closing state.
Figure 43:
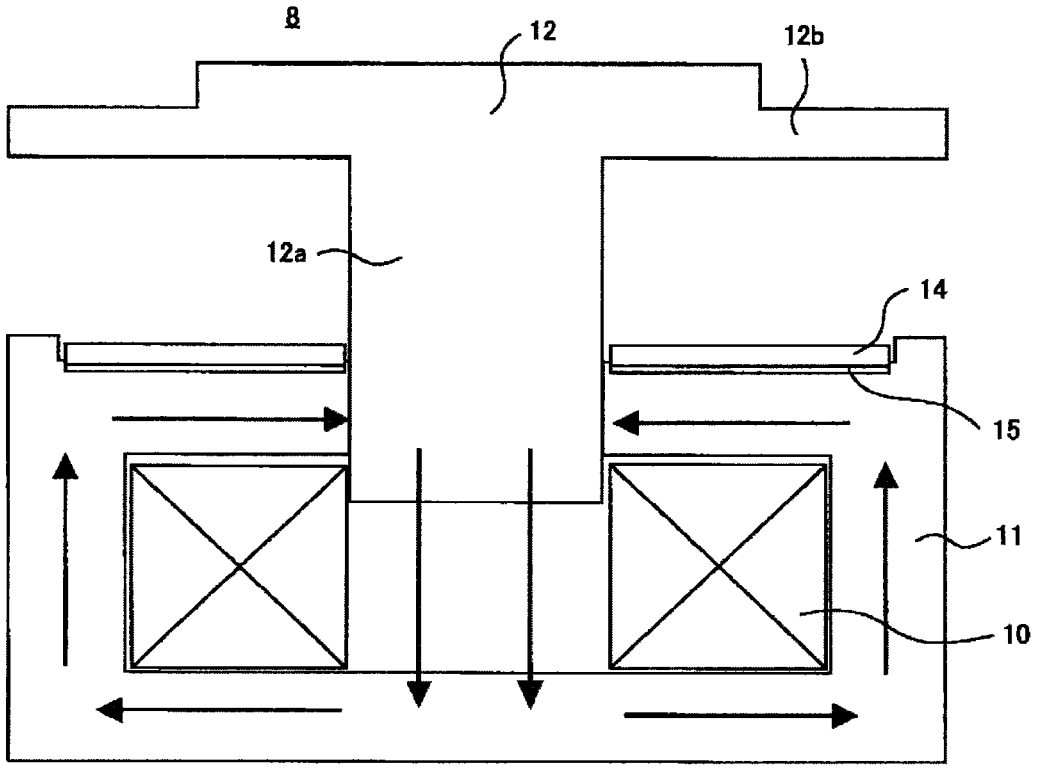
FIG. 43 A diagram showing the magnetic flux flow caused by a closing coil of the electromagnetically operated device in accordance with the fifth embodiment of the invention when the closing coil is energized in the opening state.

In FIG. 40, the holding force adjusting member 15 is placed on the underside of the permanent magnet 14. FIG. 41 shows the magnetic flux flow of the permanent magnet 14 in the closing state. FIG. 42 shows the magnetic flux flow caused by a drive coil (opening coil) 10 when the coil is energized in the closing state. FIG. 43 shows the magnetic flux flow caused by the drive coil (closing coil) 10 when the coil is energized in the opening state.

Since the magnetic flux caused by the permanent magnet 14 forms a closed loop, in the holding force adjusting member 15 placed between the permanent magnet 14 and the stationary member 11, the magnetic flux caused by the permanent magnet 14 flows, but the magnetic flux caused by the drive coil 10 does not flow. Accordingly, the magnetic flux flow caused by the permanent magnet 14 and the drive coil 10 (including the one when the coil is being driven) is the same as that of the fourth embodiment. The holding force adjustment is performed in a way similar to the fourth embodiment, by changing the dimension of the holding force adjusting member 15 to change the gap width between the permanent magnet 14 and the moving member 12. In this embodiment, since the holding force adjusting member 15 is placed between the permanent magnet 14 and the stationary member 11, the permanent magnet 14 can be mounted on the stationary member 11 by placing a set of the permanent magnet 14 and the holding force adjusting member 15, for example, by sliding from the front side of the figure, which can prevent the surface of the permanent magnet 14 from being worn by the contact with the stationary member 11.

Sixth Embodiment

Next, an electromagnetically operated device and a switching device including the electromagnetically operated device in accordance with a sixth embodiment of the invention is described.

Figure 44:
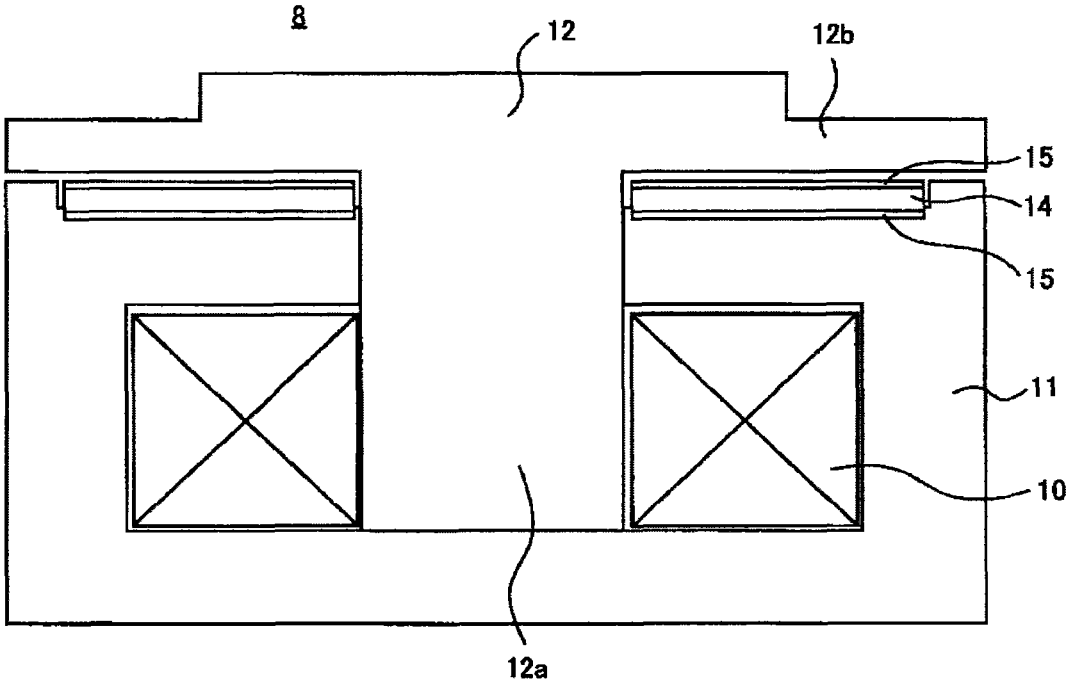
FIG. 44 A front view showing an electromagnetically operated device in accordance with a sixth embodiment of the invention.

FIG. 44 is a configuration diagram showing the electromagnetically operated device in accordance with the sixth embodiment. An electromagnetically operated device 8 in accordance with the sixth embodiment includes a holding force adjusting member 15 placed on and on the underside of a permanent magnet 14.

Note that the remaining parts are configured in the same way as the first embodiment and so are denoted by the same numerals with their description omitted.

Figure 45:
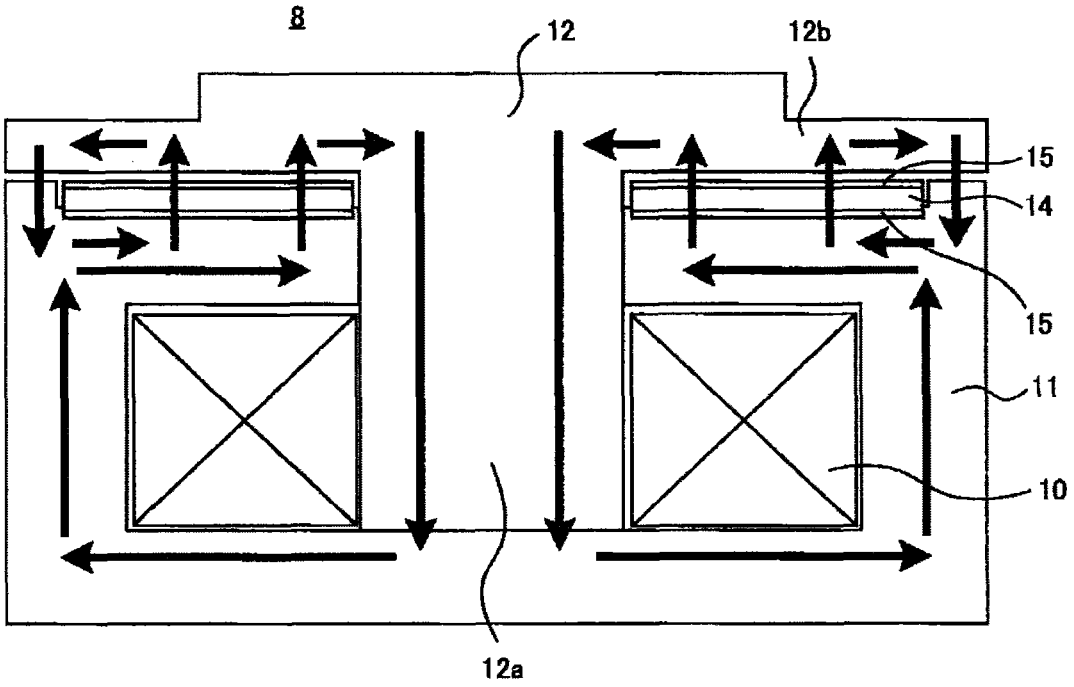
FIG. 45 A diagram showing the magnetic flux flow of a permanent magnet of the electromagnetically operated device in accordance with the sixth embodiment of the invention.
Figure 46:
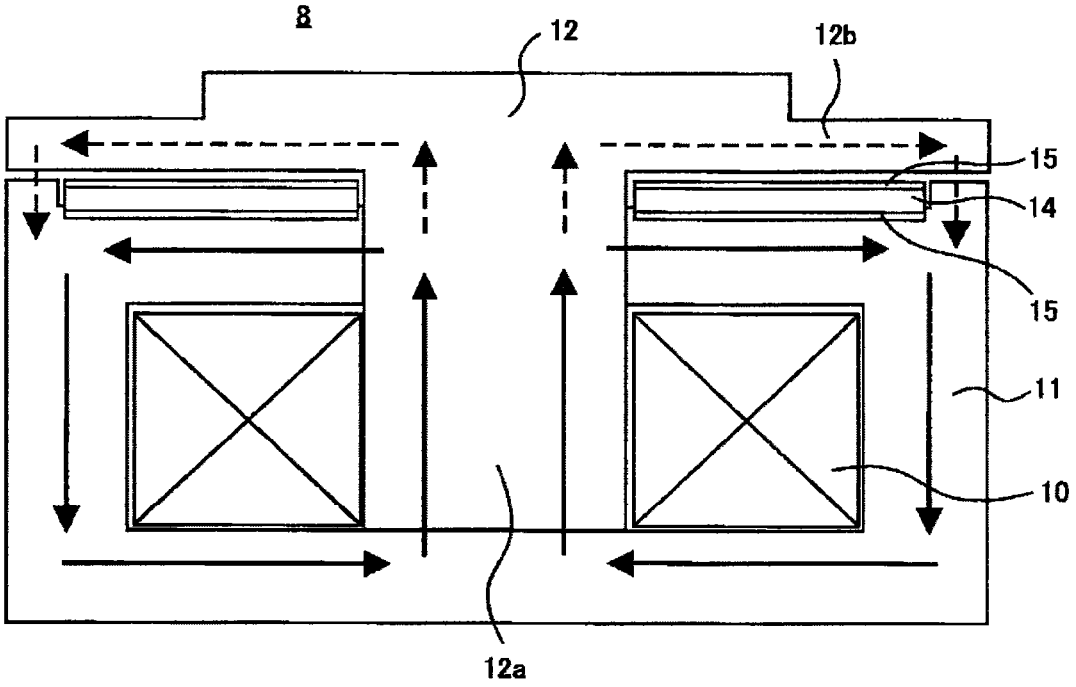
FIG. 46 A diagram showing the magnetic flux flow caused by an opening coil of the electromagnetically operated device in accordance with the sixth embodiment of the invention when the opening coil is energized in the closing state.
Figure 47:
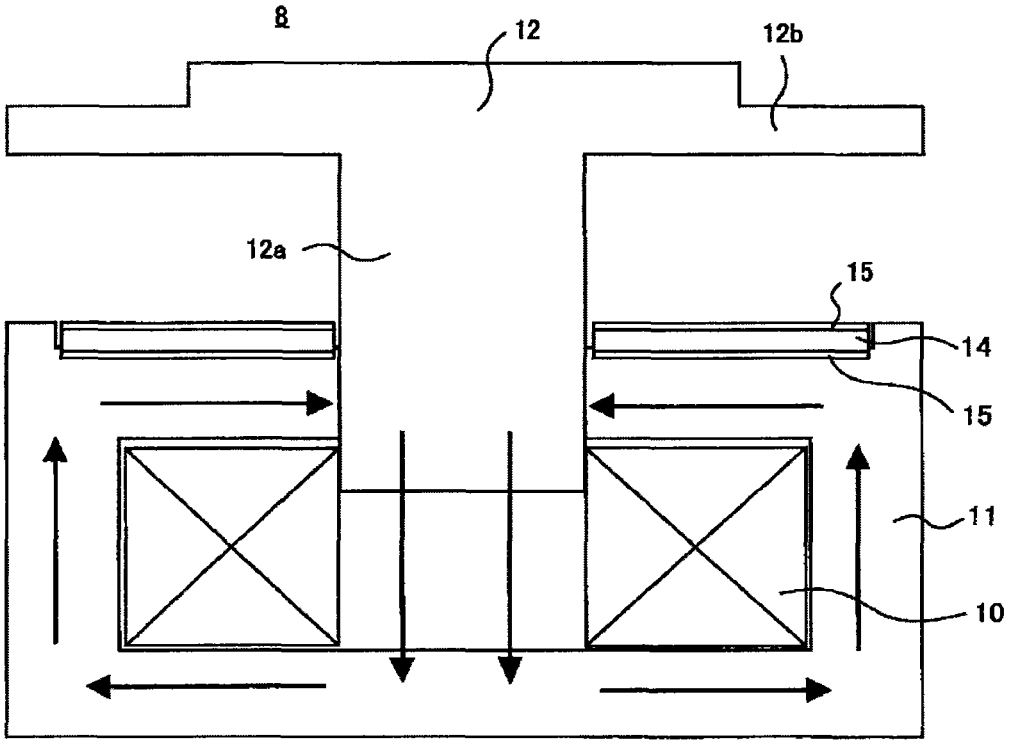
FIG. 47 A diagram showing the magnetic flux flow caused by a closing coil of the electromagnetically operated device in accordance with the sixth embodiment of the invention when the closing coil is energized in the opening state.

In FIG. 44, the holding force adjusting member 15 is placed on and on the underside of the permanent magnet 14. FIG. 45 shows the magnetic flux flow of the permanent magnet 14 in the closing state. FIG. 46 shows the magnetic flux flow caused by a drive coil (opening coil) 10 when the coil is energized in the closing state. FIG. 47 shows the magnetic flux flow caused by the drive coil (closing coil) 10 when the coil is energized in the opening state.

Placing the holding force adjusting member 15 on and on the underside of the permanent magnet 14 enables the use of the holding force adjusting member 15 between the permanent magnet 14 and stationary member 11 for protecting the permanent magnet 14 (the holding force adjusting member 15 between the permanent magnet 14 and stationary member 11 can also be used for adjusting the holding force) and enables the use of the holding force adjusting member 15 between the permanent magnet 14 and the moving member 12 for fine-tuning the gap width. Also in the sixth embodiment, the magnetic flux flow caused by the permanent magnet 14 and the drive coil 10 (including the one when the coil is being driven) is the same as that of the first embodiment.

Seventh Embodiment

Next, an electromagnetically operated device and a switching device including the electromagnetically operated device in accordance with a seventh embodiment of the invention is described.

Figure 48:
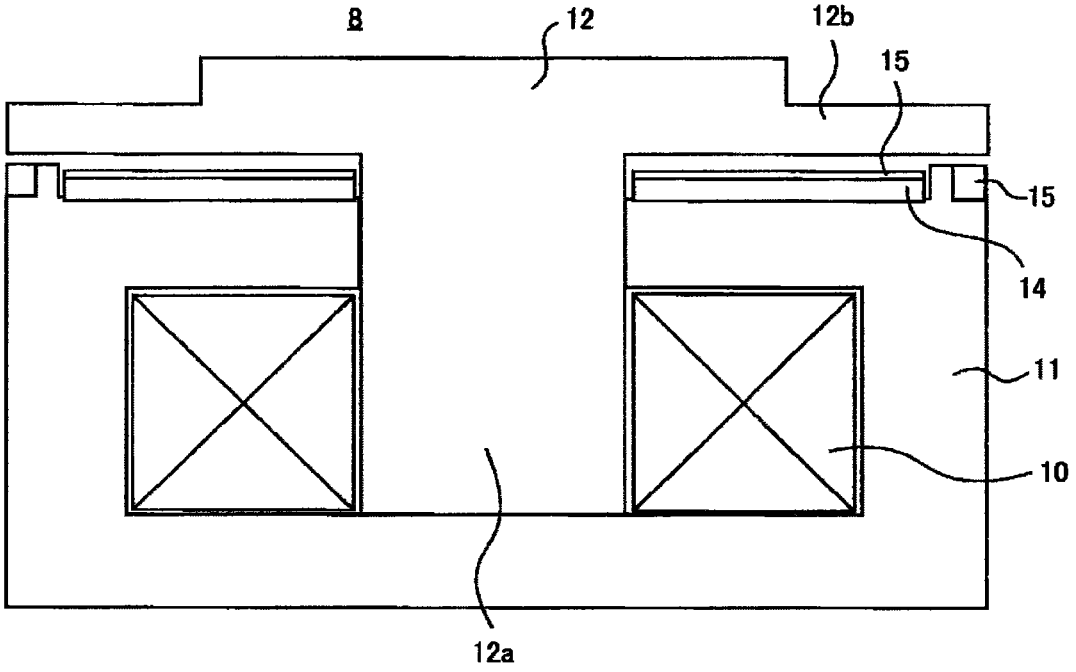
FIG. 48 A front view showing an electromagnetically operated device in accordance with a seventh embodiment of the invention.

FIG. 48 is a configuration diagram showing the electromagnetically operated device in accordance with the seventh embodiment. An electromagnetically operated device 8 in accordance with the seventh embodiment includes a holding force adjusting member 15 placed on and outside a permanent magnet 14. Note that the remaining parts are configured in the same way as the first embodiment and so are denoted by the same numerals with their description omitted.

Figure 49:
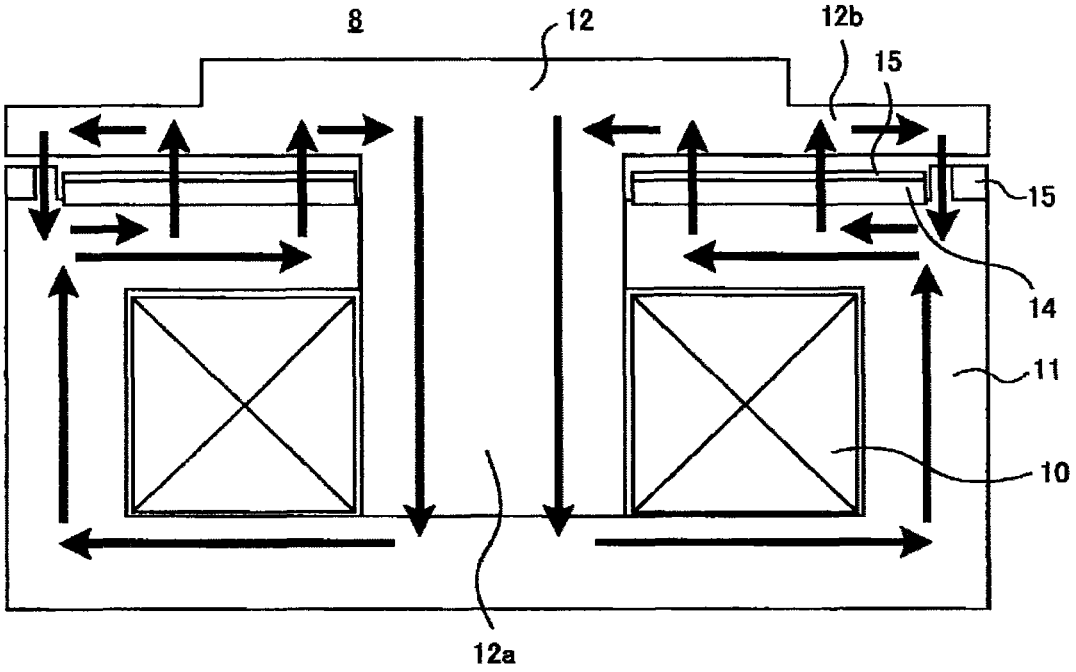
FIG. 49 A diagram showing the magnetic flux flow of a permanent magnet of the electromagnetically operated device in accordance with the seventh embodiment of the invention.
Figure 50:
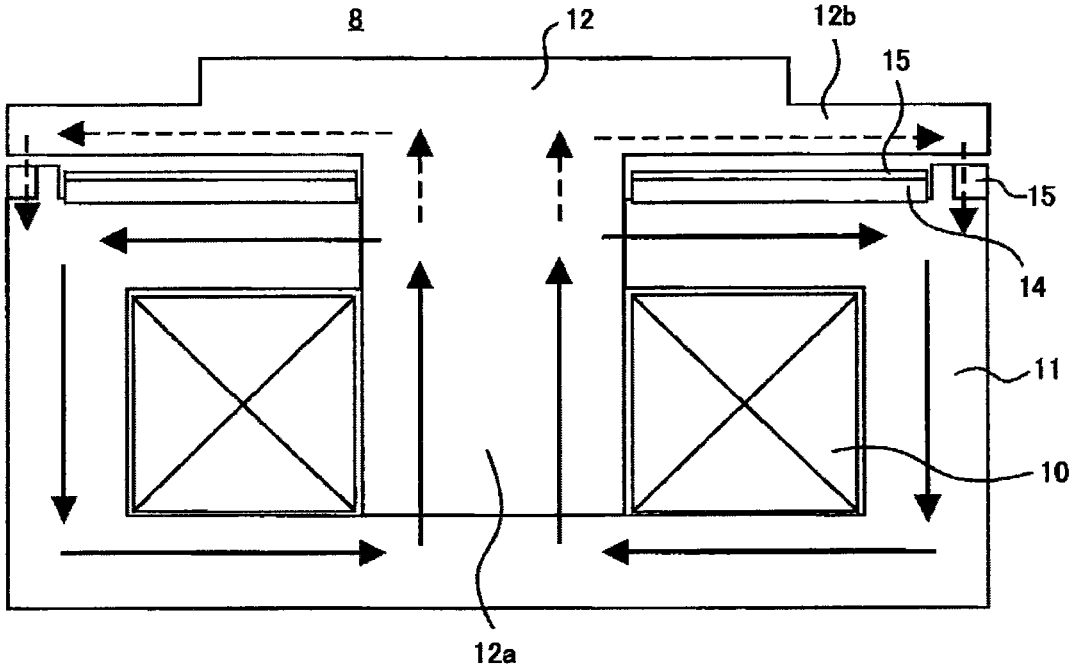
FIG. 50 A diagram showing the magnetic flux flow caused by an opening coil of the electromagnetically operated device in accordance with the seventh embodiment of the invention when the opening coil is energized in the closing state.
Figure 51:
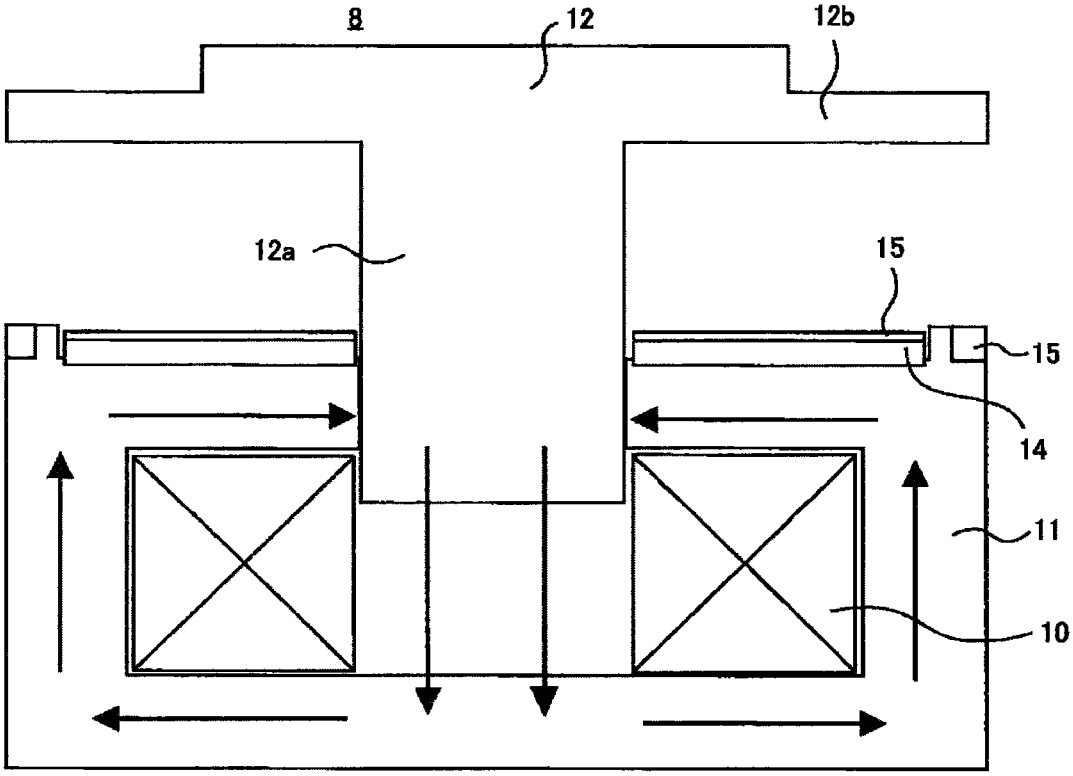
FIG. 51 A diagram showing the magnetic flux flow caused by a closing coil of the electromagnetically operated device in accordance with the seventh embodiment of the invention when the closing coil is energized in the opening state.

In FIG. 48, the holding force adjusting member 15 is placed on the permanent magnet 14 and at the outside magnetic pole of the permanent magnet 14. The holding force adjusting member 15 is placed on the magnetic pole face (stationary member and permanent magnet) opposite a moving member opposite portion 12*b*. FIG. 49 shows the magnetic flux flow of the permanent magnet 14 in the closing state. FIG. 50 shows the magnetic flux flow caused by a drive coil (opening coil) 10 when the coil is energized in the closing state. FIG. 51 shows the magnetic flux flow caused by the drive coil (closing coil) 10 when the coil is energized in the opening state.

Thus, even when the combination of the holding force adjusting member 15 is varied, the magnetic flux flow caused by the permanent magnet 14 and the drive coil 10 is the same as that of the first embodiment.

Eighth Embodiment

Next, an electromagnetically operated device and a switching device including the electromagnetically operated device in accordance with an eighth embodiment of the invention is described.

Figure 52:
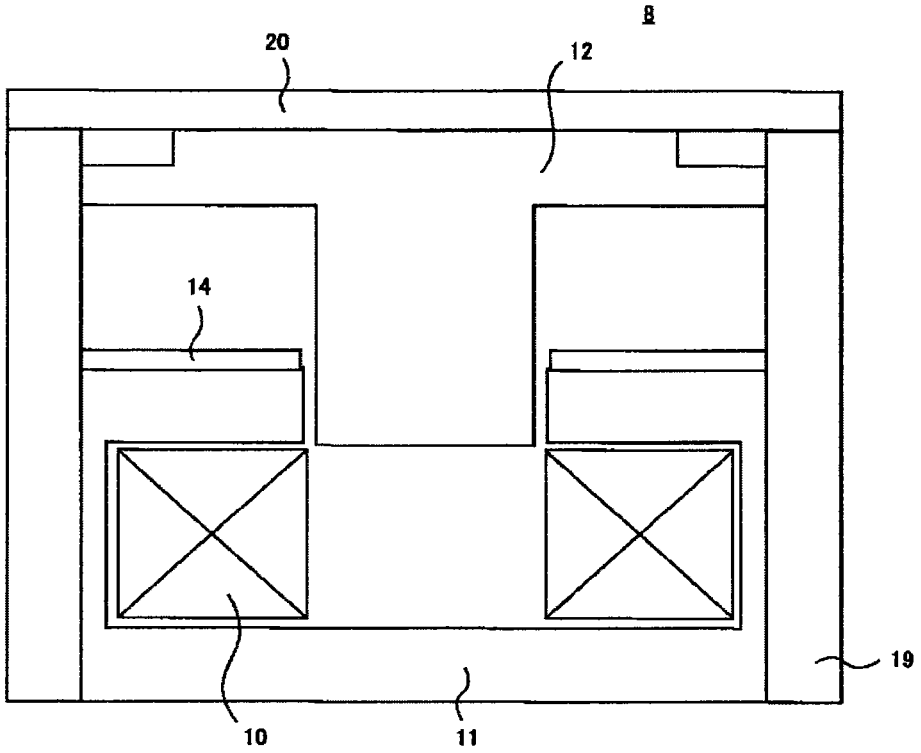
FIG. 52 A front view showing an electromagnetically operated device in accordance with an eighth embodiment of the invention in the opening state.
Figure 53:
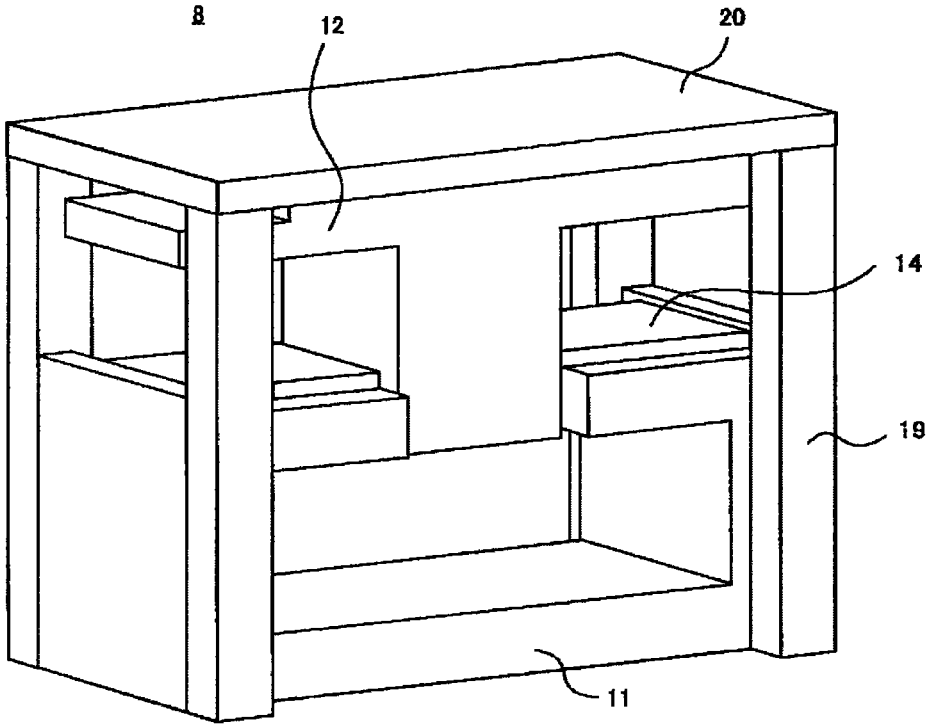
FIG. 53 A perspective view showing the electromagnetically operated device in accordance with the eighth embodiment of the invention in the opening state.

FIGS. 52 and 53 are a configuration diagram showing the electromagnetically operated device in accordance with the eighth embodiment. An electromagnetically operated device 8 in accordance with the eighth embodiment includes a supporting post 19 placed at the four corners of the stationary member 11. An opening stopper 20 for limiting the movement of a moving member 12 in the opening operation is provided on the supporting post 19. In the opening operation, the moving member 12 mechanically abuts against the opening stopper 20 to be stopped. The movement range in the driving direction of the moving member can be easily changed by changing the length in the longitudinal direction of the supporting post 19. Note that the supporting post 19 and the opening stopper 20 may be made of any appropriate magnetic or non-magnetic material as long as their mechanical strength requirements are satisfied.

Furthermore, since the supporting post 19 is placed at the four corners of the stationary member 11, configuring the supporting post 19 with a magnetic material causes the magnetic flux leakage of the permanent magnet 14 in the opening state to converge to the supporting post 19, which can suppress magnetic field leakage to the outside. FIG. 52 shows a case of single phase. When the phase spacing among the three phases is short in the vacuum circuit breaker, the capability of suppressing magnetic field leakage to the outside is particularly effective.

Furthermore, the capability of suppressing magnetic field leakage to the outside allows a maintenance personnel or operator to work without being affected by the magnetic field. Furthermore, the opening stopper 20 can suppress magnetic field leakage to the axis direction. The effect of suppressing magnetic field leakage can be similarly obtained even when the holding force adjusting member 15 is placed on and on the underside of the permanent magnet 14 as the above embodiments.

Ninth Embodiment

Next, an electromagnetically operated device and a switching device including the electromagnetically operated device in accordance with a ninth embodiment of the invention is described.

Figure 54:
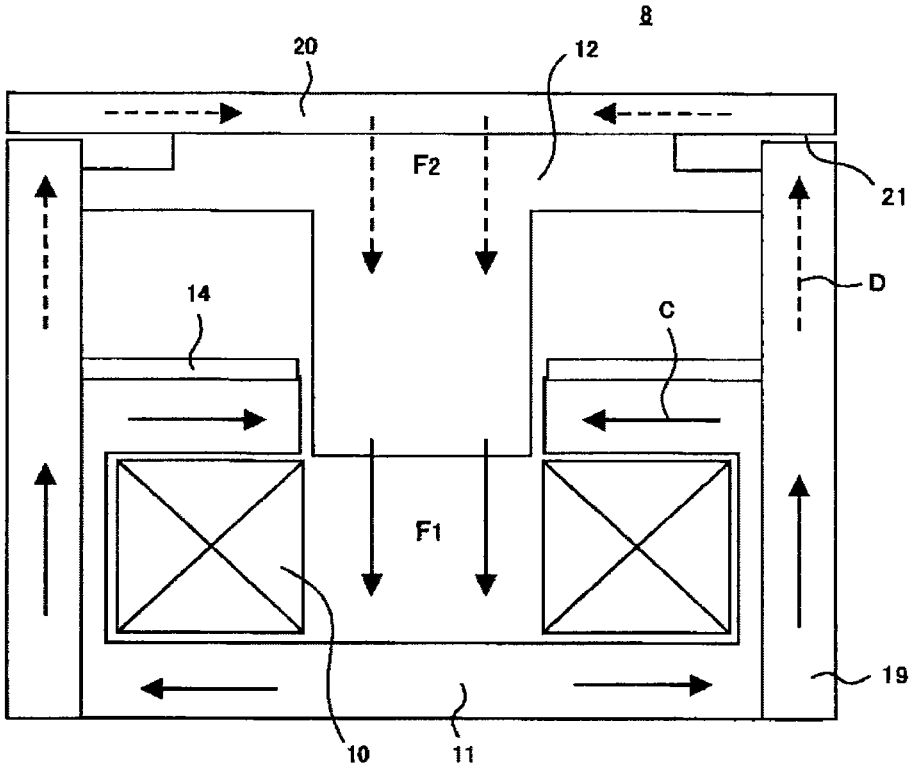
FIG. 54 A front view showing an electromagnetically operated device in accordance with a ninth embodiment of the invention in the opening state.

FIG. 54 shows an electromagnetically operated device 8 in accordance with the ninth embodiment. This is different from the electromagnetically operated device 8 in accordance with the eighth embodiment in that a gap 21 that will be a magnetic gap is provided between the supporting post 19 and the opening stopper 20. The remaining parts are configured in the same way as the eighth embodiment.

Figure 55:
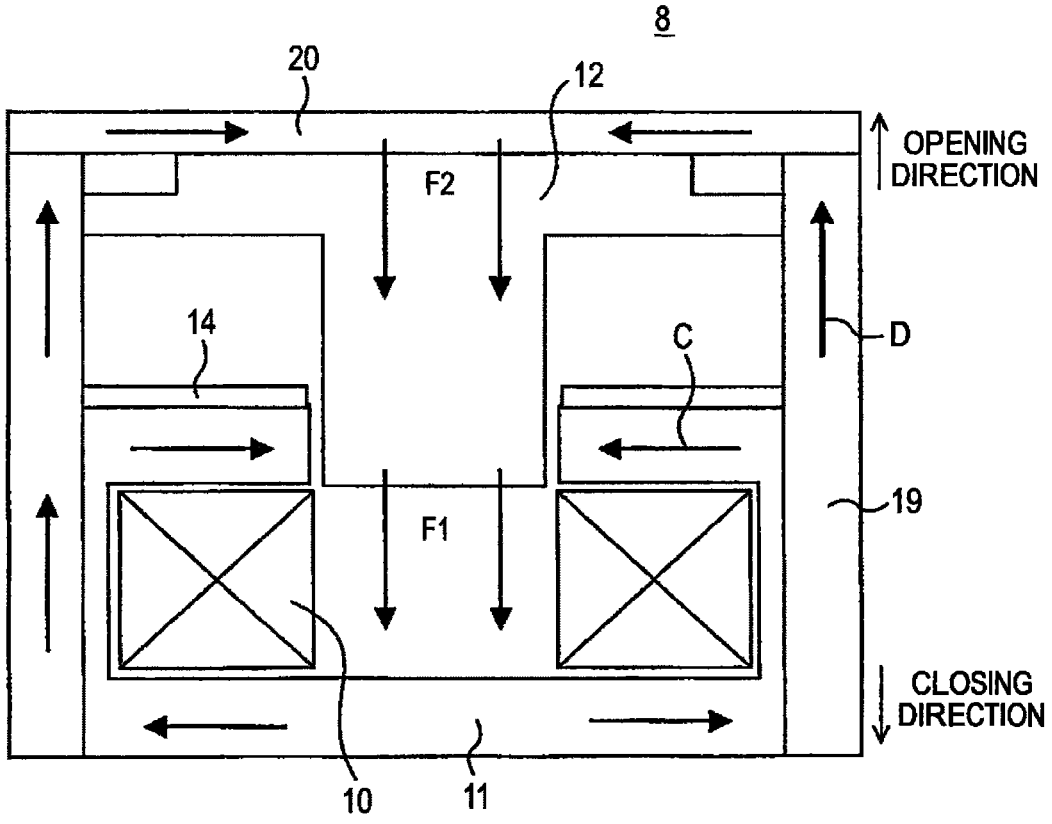
FIG. 55 A diagram showing the magnetic flux flow caused by the drive coil of the electromagnetically operated device in accordance with the eighth embodiment of the invention in the opening state with the closing operation being performed.

Next, an operation and effect of the electromagnetically operated device 8 in accordance with the ninth embodiment is described. FIG. 55 shows the magnetic flux flow caused by the drive coil 10 in the closing operation in the electromagnetically operated device 8 in accordance with the eighth embodiment in which the supporting post 19 and the opening stopper 20 are configured with a magnetic material. Note that the magnetic flux flow caused by the drive coil 10 in the closing operation in the electromagnetically operated device 8 in accordance with the ninth embodiment in which the supporting post 19 and the opening stopper 20 are configured with the same magnetic material as that of the eighth embodiment is shown in FIG. 54.

As shown in FIG. 55, the magnetic flux caused by the drive coil 10 in the closing operation in the electromagnetically operated device 8 in accordance with the eighth embodiment is divided into a magnetic path C through the stationary member 11 and a magnetic path D from the supporting post 19 and the opening stopper 20 through the moving member 12. The magnetic flux passing through the magnetic paths C and D causes the resultant of a load in the closing direction F1 and a load in the opening direction F2 to act on the moving member 12. In the closing operation, the load in the opening direction F2 will be wasted.

Figure 56:
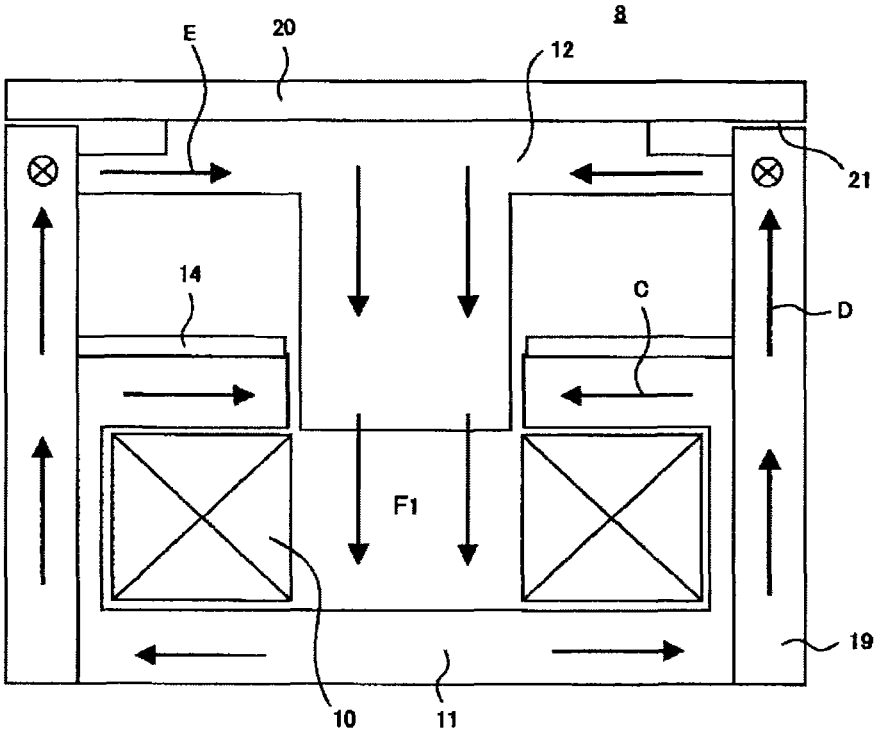
FIG. 56 A diagram showing the magnetic flux flow caused by the drive coil of the electromagnetically operated device in accordance with the ninth embodiment of the invention in the opening state with the closing operation being performed.

On the other hand, as shown in FIG. 54, in the electromagnetically operated device 8 in accordance with the ninth embodiment, providing the gap 21 that will be a magnetic gap between the supporting post 19 and the opening stopper 20 reduces the magnetic flux passing through the magnetic path D that will be wasted, causing the load in the closing direction F1 to increase even with the same magnetomotive force. Furthermore, as shown in FIG. 56, providing the gap 21 causes a magnetic path E from the supporting post 19 through the direction perpendicular to the figure and through the moving member 12, which can increase the load in the closing direction F1 without generating the load in the opening direction F2.

Tenth Embodiment

Next an electromagnetically operated device and a switching device including the electromagnetically operated device in accordance with a tenth embodiment of the invention is described.

Figure 57:
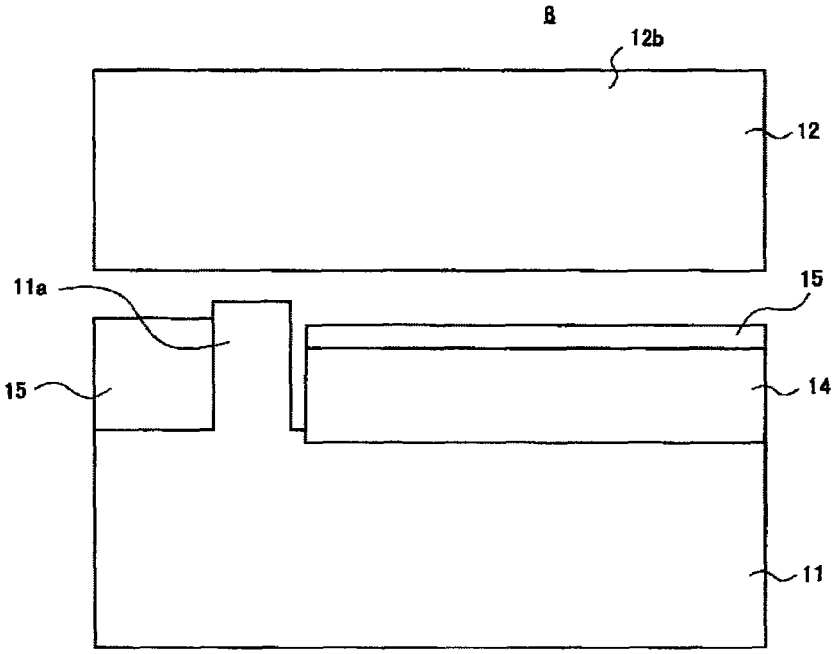
FIG. 57 An enlarged view of an area including a boundary protruding portion of an electromagnetically operated device in accordance with a tenth embodiment of the invention in the closing state.

FIG. 57 is a configuration diagram showing the electromagnetically operated device in accordance with the tenth embodiment, in which an area including a boundary protruding portion 11*a* is enlarged in the closing state of a moving member 12. The tenth embodiment is configured so that the gap between a holding force adjusting member 15 and a moving member opposite portion 12*b* formed in the moving member 12 is larger than the gap between the boundary protruding portion 11*a* and the moving member opposite portion 12*b*. If the gap between the holding force adjusting member 15 and the moving member opposite portion 12*b* is smaller than the gap between the boundary protruding portion 11*a* and the moving member opposite portion 12*b*, in the closing operation, the moving member opposite portion 12*b*, i.e., the moving member 12 may hit the holding force adjusting member 15 to deform the holding force adjusting member 15.

Since the holding force adjusting member 15 control the gap with the moving member 12 to adjust the holding force, when the moving member 12 hits the holding force adjusting member 15 in the closing operation, the controlled width of the gap may change to vary the holding force. As such, configuring so that the gap between the boundary protruding portion 11*a* and the moving member opposite portion 12*b* is smaller than the gap between the holding force adjusting member 15 and the moving member opposite portion 12*b* enables the boundary protruding portion 11*a* to work as a stopper to prevent the moving member 12 from hitting the holding force adjusting member 15. Since the moving member center portion 12*a* of the moving member 12 is configured to normally abut against the stationary member 11, a gap also exists between the boundary protruding portion 11*a* and the moving member opposite portion 12*b*, so the moving member 12 never hits the boundary protruding portion 11*a* unless the moving member 12 is abnormally deformed.

Note that, in the above embodiments, the holding force adjusting member 15 is placed at a position that will not be included in the main magnetic path of the magnetic flux caused by the drive coil 10 so as to be removable. Parts that will be included in the main magnetic path in which large magnetic flux passes when the electromagnetically operated device 8 operates may be applied with large force, so the parts needs to be securely fastened. Accordingly, if the holding force adjusting member 15 is provided between these parts, the holding force adjusting member 15 cannot be easily removed. Also in this case, in order to replace the holding force adjusting member 15 for adjustment purpose, it is necessary to release the fastening of the parts included in the main magnetic path and fasten them again, which increases time for fabrication (adjustment) and may disable an intended adjustment depending on a fabrication accuracy requirement. In the invention, the holding force adjusting member 15 is placed at a position that will not be included in the main magnetic path of the magnetic flux caused by the drive coil 10, which can provide an electromagnetically operated device with less variable holding force or a switching device including the electromagnetically operated device without leading to increase in time for fabrication (adjustment) and increase in the cost of magnet.

Furthermore, it is obvious that the holding force adjusting member 15 needs to be removable when an adjustment work of the holding force is to be done. Thus, needless to say, when the adjustment work of the holding force is completed (for example, when an adjustment before shipment is completed), the holding force adjusting member 15 may be fastened by a fastening method that does not affect the adjusted holding force, such as adhesion, swaging a non-magnetic rivet or screwing a non-magnetic bolt.

Note that the embodiments of the invention may be combined or appropriately modified or omitted within the scope of the invention.

The invention claimed is:

1. A electromagnetically operated device comprising:

a moving member of the electromagnetically operated device;

a drive coil that is energized to generate magnetic flux for driving the moving member;

a permanent magnet provided between a stationary member and the moving member for holding the moving member; and a holding force adjusting member for adjusting the holding force applied to the moving member by the permanent magnet, wherein the holding force adjusting member is placed at a position that will not be included in the main magnetic path of the magnetic flux caused by the drive coil, between the moving member and a magnetic pole face opposite the moving member.

2. The electromagnetically operated device according to claim 1, wherein a boundary protruding portion is formed on a surface of the stationary member opposite to the moving member, the boundary protruding portion dividing an opposite surface into a center portion and an outer portion, and wherein a gap between surfaces of the holding force adjusting member and the moving member opposite to each other is configured to be larger than a gap between surfaces of the boundary protruding portion and moving member opposite to each other.

3. The electromagnetically operated device according to claim 1, wherein the holding force adjusting member is placed on the magnetic pole face of the permanent magnet.

4. The electromagnetically operated device according to claim 1, wherein the holding force adjusting member is placed as part of an outside magnetic pole of the permanent magnet.

5. The electromagnetically operated device according to claim 1, wherein the holding force adjusting member is placed as part of an outside magnetic pole of the permanent magnet and also placed on the magnetic pole face of the permanent magnet.

6. The electromagnetically operated device according to claim 1, wherein the holding force adjusting member is placed as part of a center magnetic pole of the permanent magnet.

7. The electromagnetically operated device according to claim 1, wherein the holding force adjusting member is placed as part of a center magnetic pole and also as part of an outside magnetic pole of the permanent magnet.

8. The electromagnetically operated device according to claim 1, wherein the holding force adjusting member is placed on the permanent magnet opposite to the magnetic pole face.

9. The electromagnetically operated device according to claim 1, wherein an opening stopper for limiting movement of the moving member in the opening operation is provided, and a supporting post for connecting the opening stopper to the stationary member is provided at four corners of the stationary member.

10. The electromagnetically operated device according to claim 1, wherein an opening stopper for limiting movement of the moving member in the opening operation is provided, and a supporting post for connecting the opening stopper to the stationary member is provided at four corners of the stationary member, and further, a gap is provided between the supporting post and the opening stopper.

11. The electromagnetically operated device according to claim 1, wherein the holding force adjusting member is provided to be removable.

12. A switching device comprising:

a stationary electrode of a circuit breaker;

a moving electrode provided opposite to the stationary electrode; and the electromagnetically operated device according to claim 1 that is coupled to the moving electrode and causes the moving electrode to come in contact with or separate from the stationary electrode.

* * * * *